US005615002A

United States Patent [19]

Haneda et al.

[11] Patent Number: 5,615,002

[45] Date of Patent: Mar. 25, 1997

[54] ELECTROPHOTOGRAPHIC COLOR IMAGE FORMING APPARATUS WITH A PLURALITY OF IMAGE EXPOSING DEVICES ARRANGED AROUND OUTER CIRCUMFERENCE OF PHOTORECEPTOR

[75] Inventors: Satoshi Haneda; Hisayoshi Nagase; Hiroyuki Tokimatsu; Shuta Hamada; Masakazu Fukuchi; Tadayoshi Ikeda, all of Hachioji, Japan

[73] Assignee: Konica Corporation, Tokyo, Japan

[21] Appl. No.: 574,470

[22] Filed: Dec. 8, 1995

[30] Foreign Application Priority Data

| | | | |
|---|---|---|---|
| Dec. 14, 1994 | [JP] | Japan | 6-310763 |
| Jan. 13, 1995 | [JP] | Japan | 7-004315 |
| Jan. 24, 1995 | [JP] | Japan | 7-008990 |
| Jan. 24, 1995 | [JP] | Japan | 7-008991 |
| Mar. 6, 1995 | [JP] | Japan | 7-045477 |
| Mar. 6, 1995 | [JP] | Japan | 7-045478 |

[51] Int. Cl.[6] ..... G03G 15/01; G03G 15/00

[52] U.S. Cl. ..... 399/227; 347/138; 347/245; 399/167; 399/178

[58] Field of Search ..... 355/326 R, 327, 355/200, 210, 211, 228, 229; 347/138, 245, 263

[56] References Cited

U.S. PATENT DOCUMENTS

| | | | |
|---|---|---|---|
| 4,791,452 | 12/1988 | Kasai et al. | 355/326 R |
| 4,959,695 | 9/1990 | Nishimura et al. | 355/327 |

FOREIGN PATENT DOCUMENTS

| | | | |
|---|---|---|---|
| 58-57139 | 4/1983 | Japan | 355/326 R |
| 63-197968 | 8/1988 | Japan | 355/326 R |
| 3-212661 | 9/1991 | Japan | 355/326 R |

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

A color image forming apparatus provided with plural charging devices, plural image exposure devices, and plural developing devices which are arranged around the outer circumference of a photoreceptor so that a color image is formed during a single rotation of the photoreceptor. The apparatus comprises a supporting cylinder for enclosing the photoreceptor and for supporting the plural image exposure devices thereon.

43 Claims, 39 Drawing Sheets

FIG. 2 ( a )
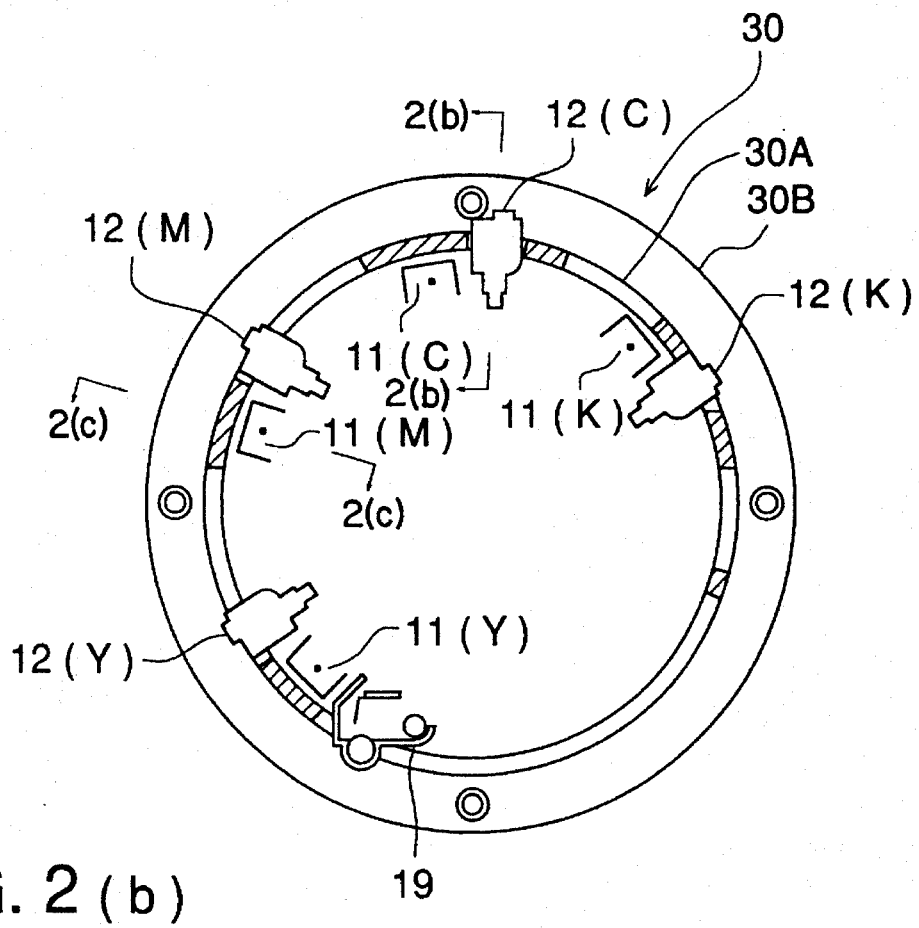
FIG. 2 ( b )
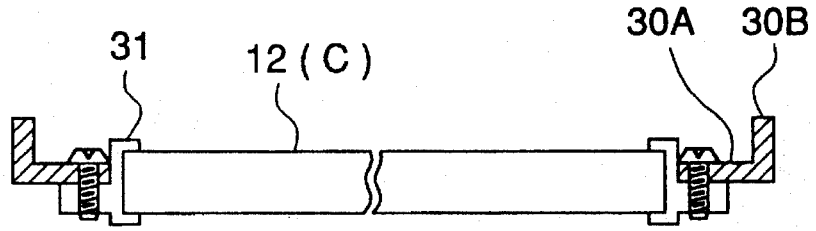
FIG. 2 ( c )
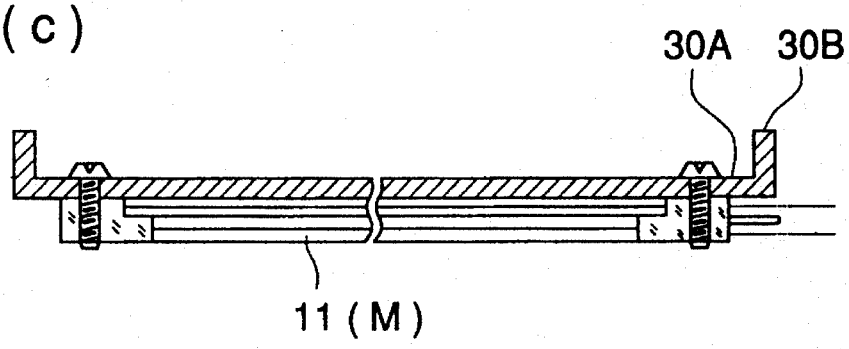

ELECTROPHOTOGRAPHIC COLOR IMAGE FORMING APPARATUS WITH A PLURALITY OF IMAGE EXPOSING DEVICES ARRANGED AROUND OUTER CIRCUMFERENCE OF PHOTORECEPTOR

BACKGROUND OF THE INVENTION

The present invention relates to an electrophotographic color image forming apparatus in which a plurality of charging means, image exposure means and developing means are arranged along the circumferential surface of a drum-shaped image-forming member, and toner images are formed and superimposed while the image-forming member is rotated by one revolution.

Concerning the method for forming a multi-color image, there have been known some methods including apparatus (A) in which photoreceptors, charging units and developing units each in quantity equivalent to the number of colors necessary for the multi-color image are provided, and toner images each being a mono-color formed on each photoreceptor are superimposed on an intermediate transfer member to form a color image, apparatus (B) in which one photoreceptor is caused to make plural turns so that charging, image exposure and developing for each color are repeated for forming a color image, and apparatus (C) in which charging, image exposure and developing for each color are conducted in succession while one photoreceptor makes one turn for forming a color image.

However, the apparatus (A) has a drawback that the dimensions of the apparatus are increased because a plurality of photoreceptors and intermediate transfer meters are required, while the apparatus (B) has a restriction that the size of a formed image is limited to the surface area or less of the photoreceptor although the dimensions of the apparatus can be small because the required number of each of the charging means, image exposure means and photoreceptor is just one.

In the case of the apparatus (C), which makes it possible to form images at high speed, it still has a contradiction that the diameter of a photoreceptor is large and thereby the apparatus is also large due to the following two reasons; one is the necessity that a plurality of charging units, image exposure means and developing units need to be arranged within a circumferential surface of the photoreceptor, and the other is the necessity that the distance between the image exposure means and the developing unit needs to be long for avoiding a possibility that image quality is deteriorated by toner leaking from the developing unit to which an image exposure optical system is located close.

For the purpose of avoiding the drawback of the aforementioned contradiction in the apparatus (C), there has been suggested an apparatus in which the base of an image-forming member is formed from a transparent material, a plurality of image exposure means are housed in the image-forming member, and a light-sensitive layer formed on the external surface of the base is exposed to light reflected on an image through the base (for example, Japanese Patent Publication Open to Public Inspection No. 307307/1993).

However, in the apparatus suggested above, since the image exposure means are provided inside the image forming member and the great number of charging devices and developing devices are mounted outside the image forming member, the construction inevitably becomes complicated. Further, a mounting and dismounting operation for the developing devices, the image forming member and the image exposure means becomes troublesome and the handling operation for the machinery components may be not easy. Also, it may be difficult to maintain a predetermined precise positional relation among the machinery components. Still further, to rotate the image forming member together with the optical exposure system incorporated in the image forming member and to mount or dismount the image forming member requires a difficult technique.

In particular, the optical exposure system is arranged with high precision among LEDs and between each LED and the image forming member. Accordingly, if deformation or positional deviation takes place on the optical exposure system at the time of mounting or dismounting the image forming member, the registration of the superimposed images or the image forming position may be deviated, resulting in that a good quality image may be not obtained.

SUMMARY OF THE INVENTION

In order to solve the above problems, an objective of the present invention is to provide a color image forming apparatus in which the image exposure means, image forming member, charging means and developing means are easily and surely mounted onto respective predetermined positions or dismounted from the mounted positions, the positional relation among those means can be maintained without deviation even with a change in environmental temperature, and maintenance operations can be conducted easily.

In a color image forming apparatus in which charging, image exposure and developing are repeated during a single rotation of a drum-shaped image forming member so that plural toner images differing color are superimposed on the image forming member, and the superimposed plural toner images are transferred onto a transfer sheet at a time, the above objective is attained by the color image forming apparatus characterized in that there is provided a cylindrical supporting member coaxially enclosing the image forming member, and the image exposure means are supported by the cylindrical supporting member.

In the color image forming apparatus, at least one of the charging means and the cleaning means is provided on the supporting member.

In the color image forming apparatus, the supporting member has a cut-out portion and the image forming member and the cleaning means are integrally constructed in a single unit, wherein the unit is structured to be mounted inside the supporting member on the condition that the cleaning means locates the cut-out portion of the supporting member.

In the color image forming apparatus, the image exposure means are mounted radially on the cylindrical supporting member.

In the color image forming apparatus, the image exposure means is a laser beam scanner.

In the color image forming apparatus, the image forming member is incorporated in a unit frame on which four sets of charging devices are mounted, four sets of image exposure means are radially mounted on the periphery wall of the cylindrical supporting member in which the image forming member is enclosed, and the four sets of developing devices are mounted through openings provided on both of the supporting member and the unit frame so that the fore side of the developing devices come close to the outer periphery of the image forming member on a right side position, a left side position, a slightly right position from the top and a slightly left position from the top respectively. A toner replenishing container is connected on a upper back side position of each of the developing devices. The developing devices are drawn out of the periphery wall of the image forming member along a developing device supporting guide in the horizontal direction or in the radial direction depending on respective mounting positions. On the condition that the developing devices are drawn out, the unit frame can be mounted on or dismounted from the apparatus body.

In the color forming apparatus in which plural sets of the charging device, the image exposure means, and the developing devices, the transfer device and the cleaner are provide on the outer periphery of the drum-shaped image forming member and a color image is formed at relatively faster speed, since the plural image exposure means are mounted radially on the cylindrical supporting member enclosing the image forming member, the incident position of image light from each image exposure means onto the image forming member can be easily set at a predetermined position and high quality color image can be formed on the image forming member without color deviation. Further, as the image exposure means for forming dot images, instead of a aligned light emitting member in which light emitting elements such as LEDs are aligned in parallel to the axis of the image forming member, in the case of using a laser scanner which can easily increase the density of dots and has a deeper focal depth as merits, in contrast as demerits, which has a movable member being likely to generate a vibration and has a relatively longer image exposure optical path being likely to cause a positional deviation, the body section of the supporting member on which the exposure means are mounted is shaped in the form of a cylinder, thereby refraining the occurrence of the vibration and the positional deviation of the image exposure and forming more clear color image.

The supporting member on which the image exposure means are mounted includes a body section provided with holes for receiving plural developing devices and hole for receiving the transfer device. The one end of the body section is fixed to the apparatus body and the other end of the body section is opened so at to receive the image forming member therein. The image forming member is rotatably supported in the unit frame. The unit frame has a periphery wall enclosing the outer periphery of the image forming member. On the periphery wall are provided cut-out grooves or holes through which the image exposure means or the image light pass over. The unit frame is moved in the axial direction of the image forming member through the opening end of the supporting member on the condition that the plural developing devices are dismounted outside the unit frame so that the unit frame is mounted on or dismounted from the apparatus body. With this construction, the assembling work, the maintenance work, and the replacing work for the image forming member and image forming means associated with the image forming member and the toner replenishing work for the developing deviced can be conducted easily. As a result, the developing device can be made smaller, the image forming member and the periphery of the image forming member can be made compact, and the apparatus can be made relatively small and manufacture at low cost.

Another objective is to provide a color image forming apparatus in which deformation and distortion hardly occur and there is provided an image forming member on the periphery of which the charging means and the other means are arranged without interfering to each other even the diameter of the image forming member is relatively small.

In a color image forming apparatus in which plural charging means for providing a electric potential level, plural image exposure means for forming a latent image and plural developing means for visualizing the latent image are provided on the outer periphery of the drum-shaped image forming member, and charging, image exposure and developing are repeated during a single rotation of a drum-shaped image forming member so that plural toner images differing color are superimposed on the image forming member, and the superimposed plural toner images are transferred onto a transfer sheet at a time, the above objective is attained by the color image forming apparatus characterized in that the image forming member comprises a base member and a photosensitive layer on the outer periphery of the base member, and the base member has a thickness of 5 mm to 15 mm.

In the color image forming apparatus, the incident angles of image light from the exposure means onto the periphery surface of the image forming member may be slanted.

BRIEF DESCRIPTION OF THE DRAWINGS

FIGS. 2(*a*) , 2(*b*) and 2(*c*) are sectional views of a cylindrical supporting member.

DETAILED DESCRIPTION OF THE PREFERRED EMBODIMENT

Figure 1:
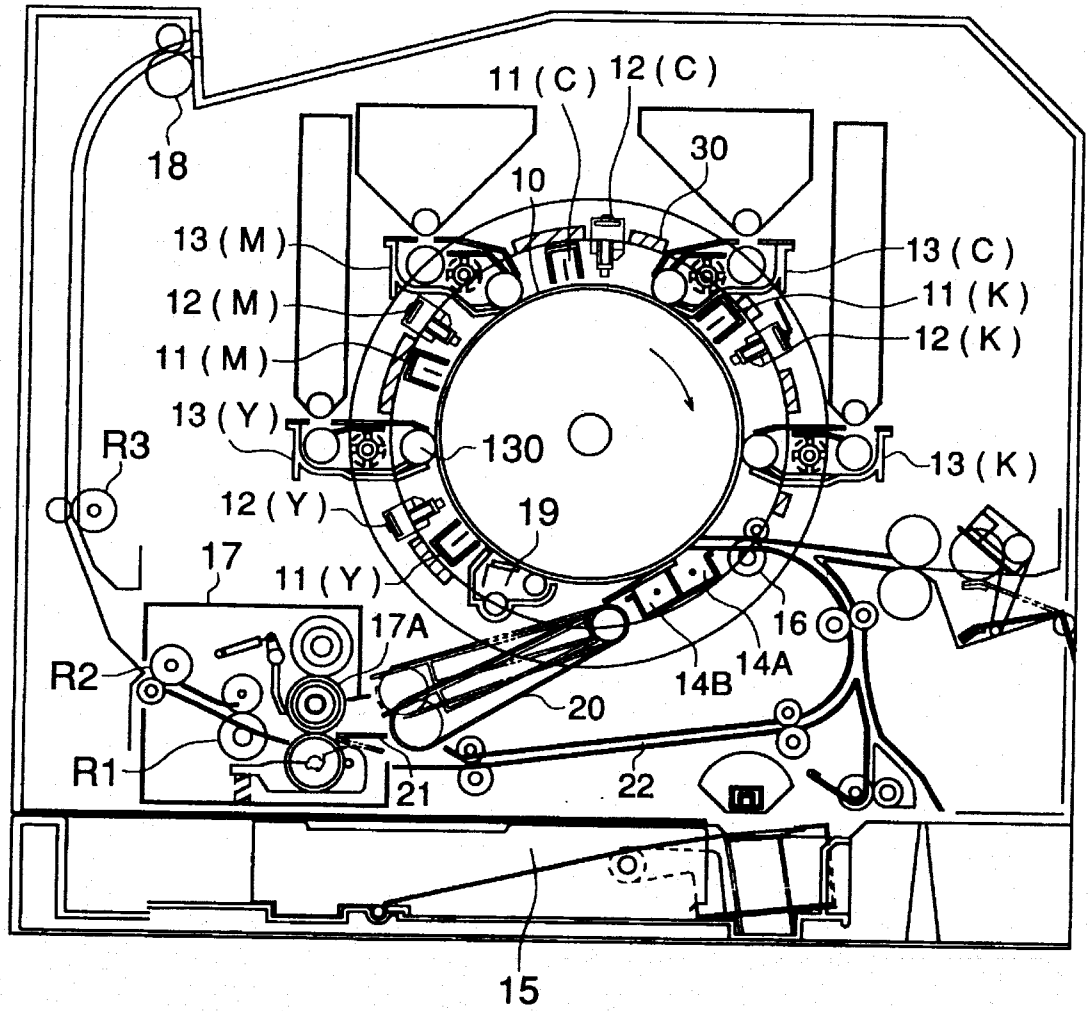
FIG. 1 is a sectional view showing a construction of a color image forming apparatus of the present invention.

The structure and function of a color image forming apparatus of the present invention will be explained as follows, referring to FIGS. 1 through 5.

The numeral 10 is a photoreceptor drum used a drum-shaped image-forming member in which an organic photoconductor (OPC) is coated on a drum. The photoreceptor drum is rotated in the clockwise direction in an electrically grounded condition.

The numeral 11 represents a scorotron charging unit, and they charge electrically the organic photoconductor layer of the photoreceptor drum 10 by corona discharge by means of a grid retained at a predetermined potential level and of a corona wire, whereby the photoreceptor drum 10 is given uniform potential.

Numeral 12 represents an optical exposure system used as image exposure means comprised of light emitting elements such as LED, FL, EL, and PL arranged in the axial direction of the photoreceptor drum 10 and a Selfoc lens. Image signals for each color read by a separate image reading device are taken out successively from a memory and are inputted as electric signals into each of the optical exposure systems 12. The wavelength of light emitted by the light emitting elements used in this embodiment is in the range of 700 to 900 nm.

Instead of the above light emitting elements, the optical exposure system 12 may comprise a light emitting element combined with an optical shutter member such as LCD, LISA, PLZT and an image forming lens such a Selfoc lens.

The numerals 13Y, 13M, 13C, 13K are developing devices, as a developing means, containing respectively a corresponding one of developing agents of yellow (Y), magenta (M), cyan (C) and K (black), and each developing device is equipped with a developing sleeve 130 which is located to keep a predetermined gap distance to a circumferential surface of the photoreceptor drum 10 and rotates in the same direction as that of the photoreceptor drum 10.

Each developing device conducts a reversal development on a non-contact condition under an application of a developing bias voltage for an electrostatic latent image which has been formed on the photoreceptor drum 10 through a charging process by the charging device 11 and an image exposure process by the optical exposure system 12.

Next, a color image forming process in the apparatus of the present invention will be explained.

An image on a document read by an image sensor in an image reading device which is separate from the present apparatus, or an image compiled by a computer is stored in a memory temporarily as image signals of each color of Y, M, C and K.

At the start of an image recording, a photoreceptor driving motor starts rotating so as to rotate clockwise the photoreceptor drum 10 and, simultaneously, the scorotron charging unit 11 (Y) starts providing an electric potential to the photoreceptor drum 10 through its charging action.

After the photoreceptor drum 10 has been provided with the electric potential, an image exposure is started by electric signals corresponding to the first color signals, that is, magenta (Y) image signals in the optical exposure system 12 (Y), and an electrostatic latent image corresponding to a magenta (Y) image of the document image is formed on a light-sensitive layer on the surface of the drum with the rotary scanning of the drum.

The latent image is subjected to the reversal development conducted by a developing unit 13 (Y) under the non-contact condition of developing agent on a developing sleeve, and a yellow (Y) toner image is formed on the photoreceptor drum 10 as the photoreceptor drum 10 rotates Then, photoreceptor drum 10 is further provided with an electric potential on the yellow (Y) toner image formed thereon through a charging operation of the charging unit 11 (M), then an image exposure is conducted by electric signals corresponding to the second color signals, that is, magenta (M) image signals, in the optical exposure system 12 (M), and a cyan (M) toner image is superimposed on the aforementioned magenta (Y) toner image through the non-contact type reversal development by the developing unit 13 (M).

In the same process as in the foregoing, a cyan (C) toner image corresponding to the third color signals is formed and superimposed by the charging unit 11 (C), optical exposure system 12 (C) and developing unit 13 (C), and, lastly, a black (K) toner image corresponding to the fourth color signals is formed and superimposed in succession by the charging unit 11 (K), the optical exposure system 12 (K) and the developing unit 13 (K), whereby a color toner image is formed on the circumferential surface of the photoreceptor drum 10 within its one rotation.

A color toner image thus formed on the peripheral surface of the photoreceptor drum 10 is transferred in a transfer device 14A onto a transfer sheet as a transfer member which is sent out from a sheet feed cassette 15 and is fed synchronously with the toner image on the photoreceptor drum 10 by the drive of the timing roller 16.

A transfer sheet onto which the toner image has been transferred is electrically discharged by the discharger 14B, so that the transfer sheet P is separated from the peripheral surface of the drum. In a fixing unit 17, the toner image is fused and fixed onto the transfer sheet. After that, the transfer sheet is discharged to a paper discharge tray on an upper portion of the apparatus through a paper discharge rollers 18.

In the case that both-sided copy, when a conveying belt 20 and a fixing guide 21 move respectively to positions indicated with two doted lines and, simultaneously, a fixing roller 17A and each of conveying rollers R1, R2 and R3 is rotated reversely, the transfer sheet passed through the fixing device 17 is conveyed reversely by the fixing device 17 and is conveyed to the sheet reversing passage. When the transfer sheet is conveyed again through the sheet reversing passage 22 to the sheet feeding passage communicated with a sheet feeding cassette 15, the surface of the transfer sheet is reversed. Thereafter, the reversed transfer sheet is fed again through a timing roller 16 to a transfer section and receives an image of the reverse side of an original document. When the conveying belt 20 and the fixing guide 21 return to their initial positions and, simultaneously, a fixing roller 17A and each of conveying rollers R1, R2 and R3 is switched so as to rotate regularly, the image of the reverse side on the transfer sheet is fixed. After the transfer sheet records images on its both sides, the transfer sheet is delivered.

On the other hand, after the transfer sheet has been separated from the photoreceptor drum 10, the residual toner on the surface of the photoreceptor drum 10 is removed and the surface of the photoreceptor drum 10 is cleaned in a cleaning device 19. In this way, the toner image formation is continued for a document image, or alternatively the toner image formation is once stopped and the apparatus waits for a next toner image formation for a new document image.

Figure 3:
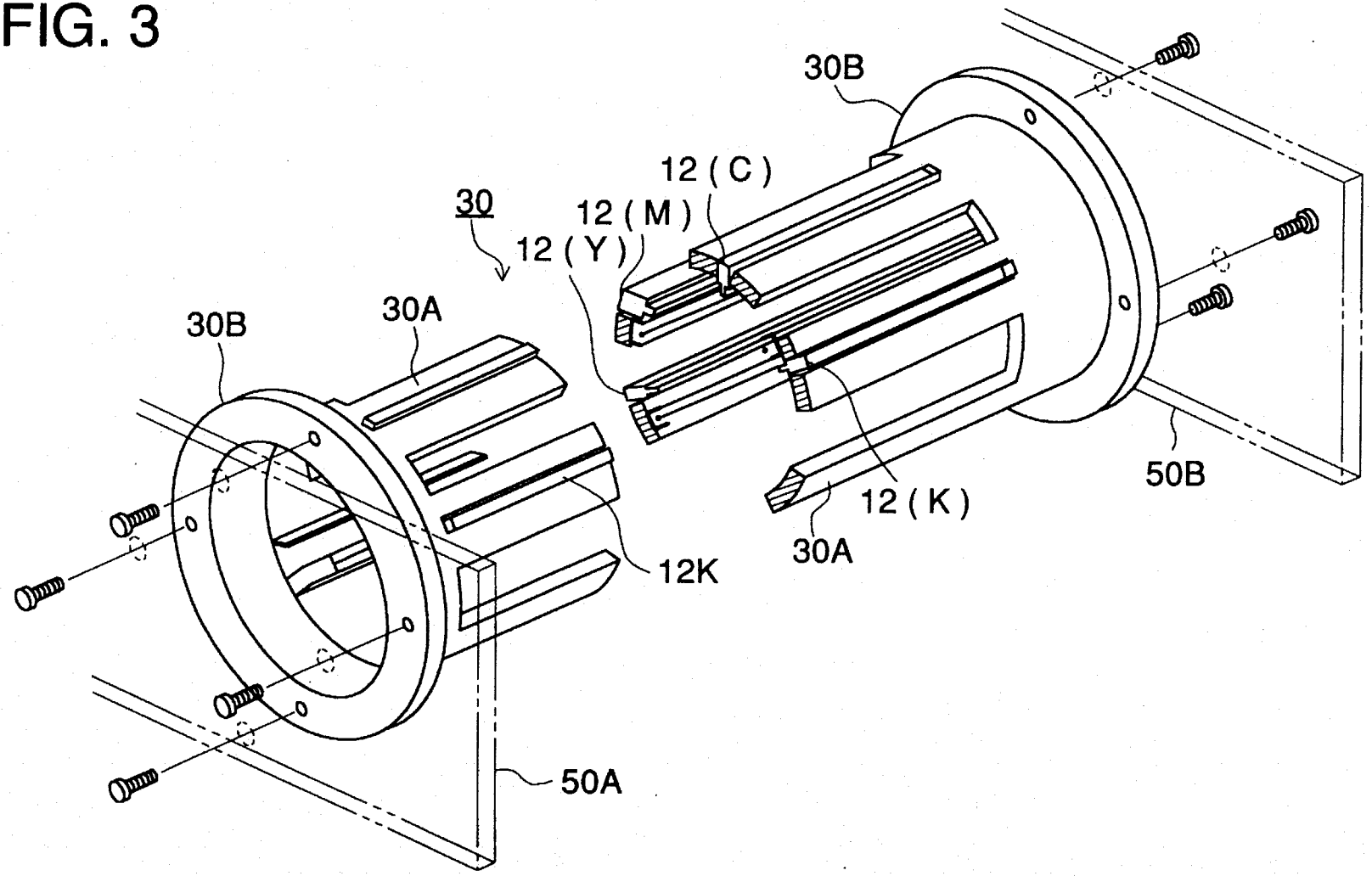
FIG. 3 is a perspective view of the supporting member.

A cylindrical member in which the photoreceptor drum 10 is coaxially incorporated will be explained hereinafter. As shown in FIGS. 2 and 3, the cylindrical member 30 comprises a cylinder section 30A distant with a predetermined space from the circumferential surface of the photoreceptor drum 10 and flanges 30B provided on both ends of the cylinder section 30A.

The cylinder section 30A is provided with a plurality of cut-out holes on its circumferential surface. As shown in FIG. 2(*b*), which is a sectional view taken along line 2*b*—2*b* in FIG. 2(*a*) each optical exposure system 12 with a supporting member 31 is fixed on the internal surface of the cylinder section 30A by means of fixing screws or an adhesive after positional adjustment.

In FIG. 2(*c*) showing a sectional view taken along line 2*c*—2*c* of FIG. 2(*a*), each charging device 11 is fixed on the internal surface of the cylinder section 30A in such the way that electrode blocks located on both ends of the charging section 11 are fixed with screws. On the internal surface of the cylinder section 30A, it may be possible to fix a cleaning device 19 in place of the charging device 11 or together with the charging device 11. Since each of the charging device 11 and the cleaning device is fixed with screws, the replacement work for them can be easily conducted.

As shown in FIG. 3, the cylinder section 30A on which the optical exposure systems 12, the charging devices 11 and the cleaning device 19 are mounted is installed in such a manner that each flange section 30B is fixed to base plates 50A and 50B on the apparatus body with screws so that the cylinder section 30A incorporates the photoreceptor drum 10 therein on the condition that the axis of the cylinder section 30A and the photoreceptor drum 10 agree with each other.

Alternately, the following structure may be adopted: That is, only the optical exposure system 12 are mounted on the cylinder section 30A, the charging devices 11 and the cleaning device 19 are mounted on a portion of the image forming member side, for example, on a cartridge in which the photoreceptor drum 10 is accommodated.

Figure 4:
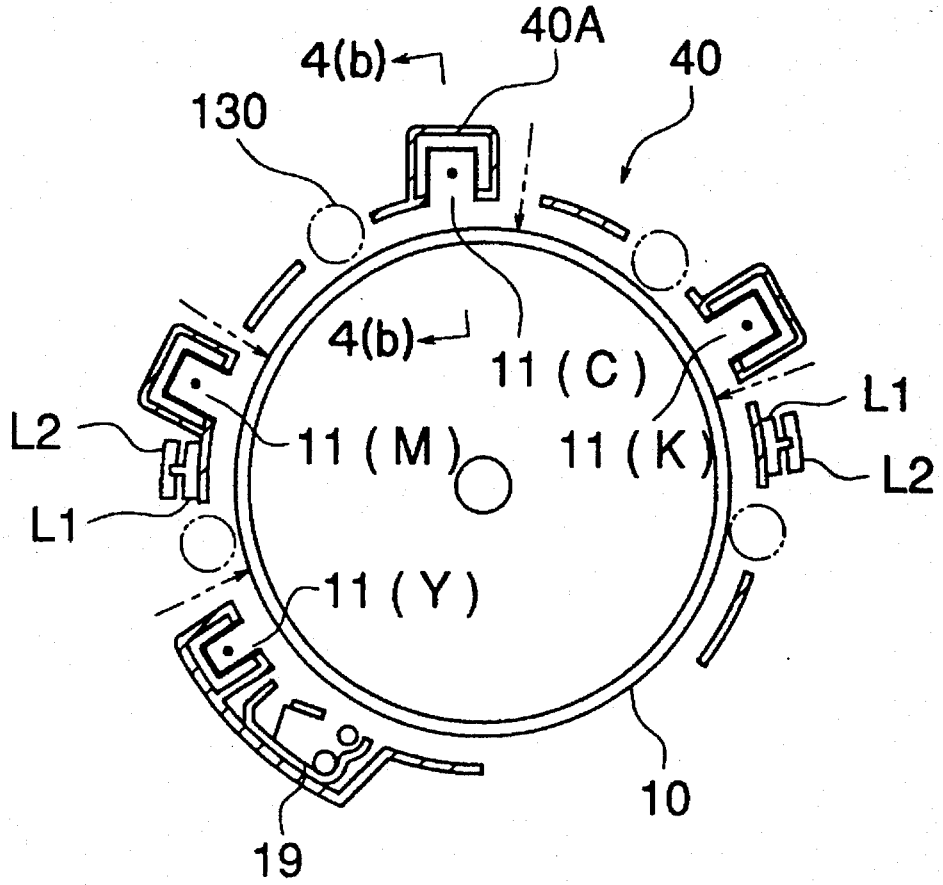
FIGS. 4(*a*) and 4(*b*) are sectional views of a cartridge.
Figure 4:
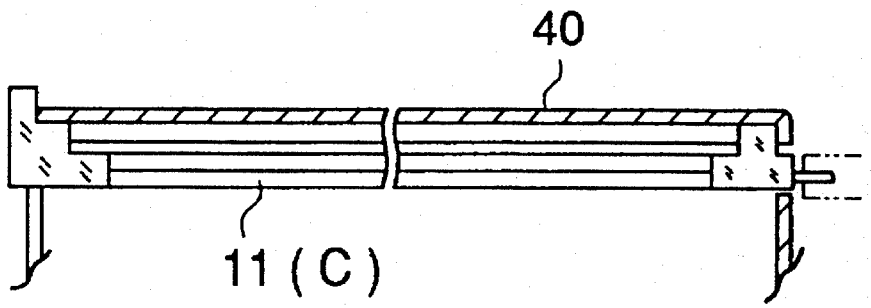
Figure 5:
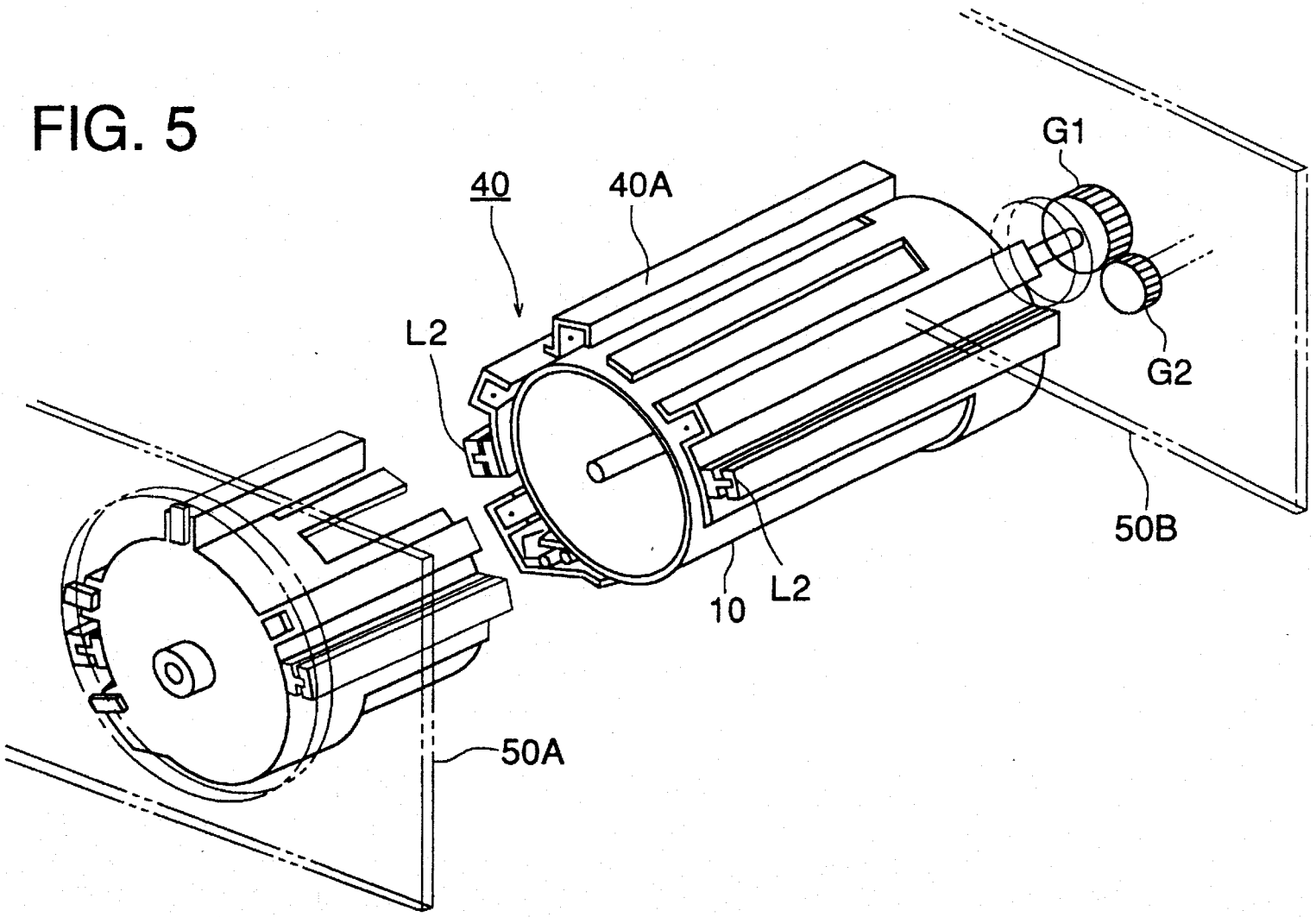
FIG. 5 is a perspective view of the cartridge.

In FIG. 4(*a*), the numeral 40 is a cartridge in which the photoreceptor drum 10 is supported with its bearing. As illustrated in FIG. 4(*b*) showing a sectional view taken along line 4*b*–4*b* in FIG. 4(*a*), the charging device 11 is inserted from one side of the cartridge 40 and is engaged and fixed in space 40A formed in the axial direction on the circumferential surface of the cartridge 40.

The cartridge 40 is provided with a pair of rail members L1 at symmetrical positions on its circumferential surface and guide members L2 are provided on the inside of the cylindrical member 30 in the apparatus body. The cartridge 40 is mounted on a predetermined image forming position in such a manner that the rail members L1 are inserted in the guide members L2. On the image forming position, the optical exposure system 12 and the developing sleeve 130 of the developing devices face the circumferential surface of the photoreceptor drum 10 through the cut-out sections provided on the circumferential surface of the cartridge 40.

With the mounting operation to mount the cartridge 40 on the image forming position, an electric connection between the charging devices 11 and a power source, a gear engagement between a gear G1 on a rotational shaft on the photoreceptor 10 and a driving gear G2, and a connection between the cleaning device 19 and a power transmitting system are conducted.

It is possible to replace each charging device 11 and the cleaning device 19 individually. However, if the life cycle of the devices is made equal to that of the photoreceptor drum 10, the cartridge 40 including all of the devices may be replaced with a new one so that a maintenance operation may be simplified.

Incidentally, it may be possible to mount the charging devices 11 and the cleaning device 19 separately on the cylindrical member 30 and the cartridge 40.

Figure 6:
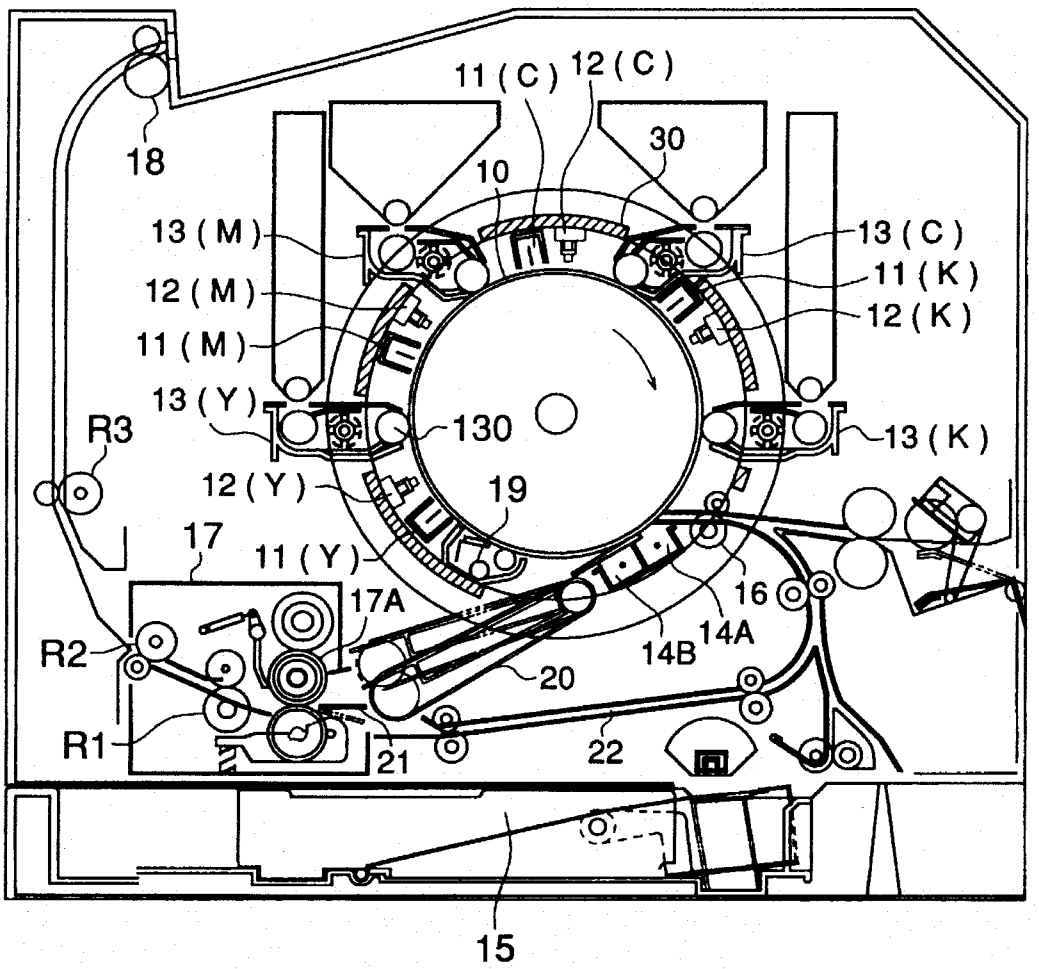
FIG. 6 is a sectional view showing a construction of a color image forming apparatus of another embodiment of the present invention.
Figure 7:
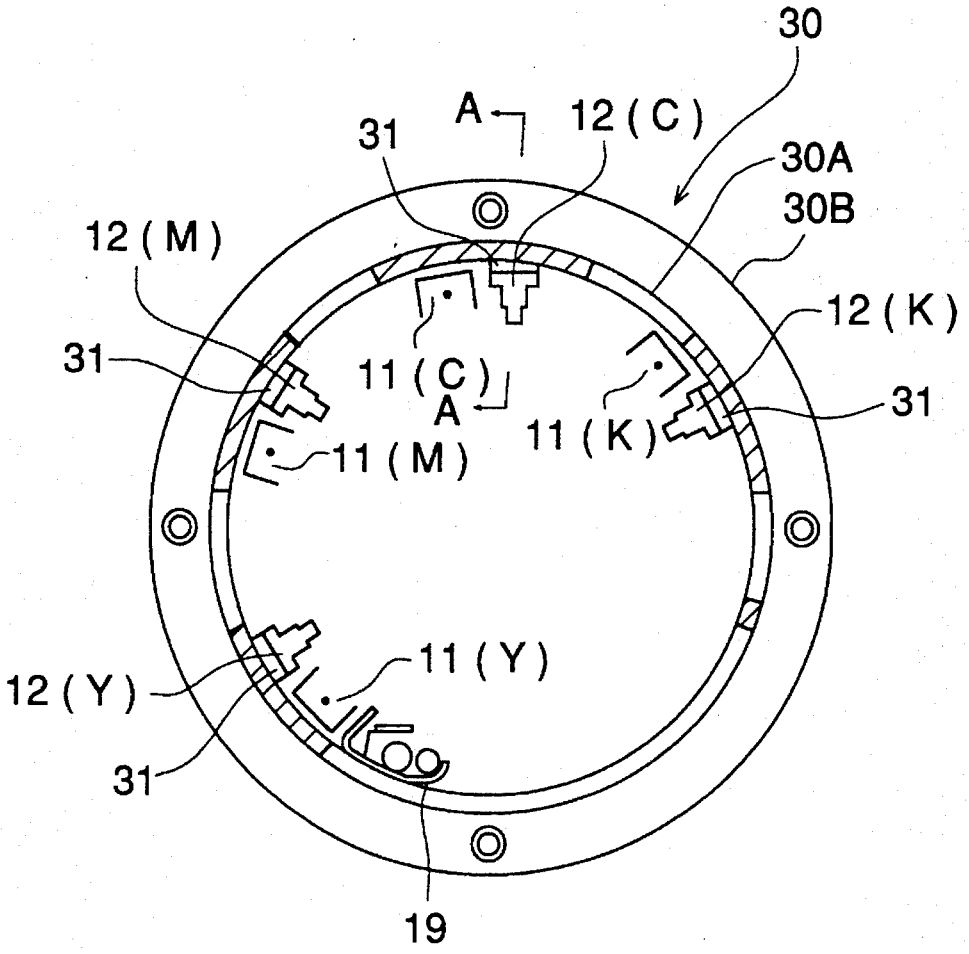
FIGS. 7(*a*) and 7(*b*) are sectional views of a cylindrical supporting member.
Figure 7:
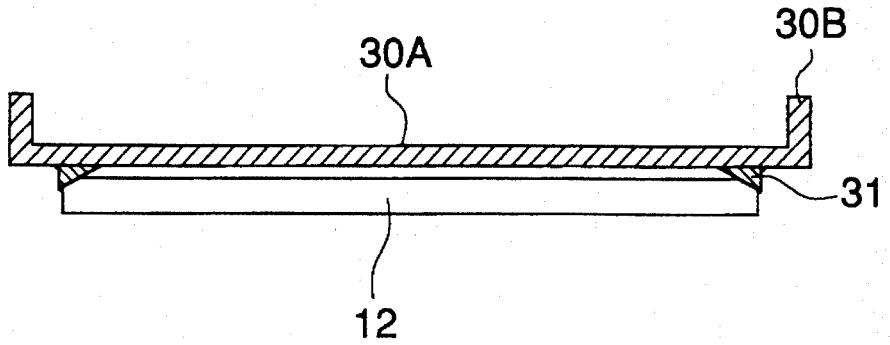
Figure 8:
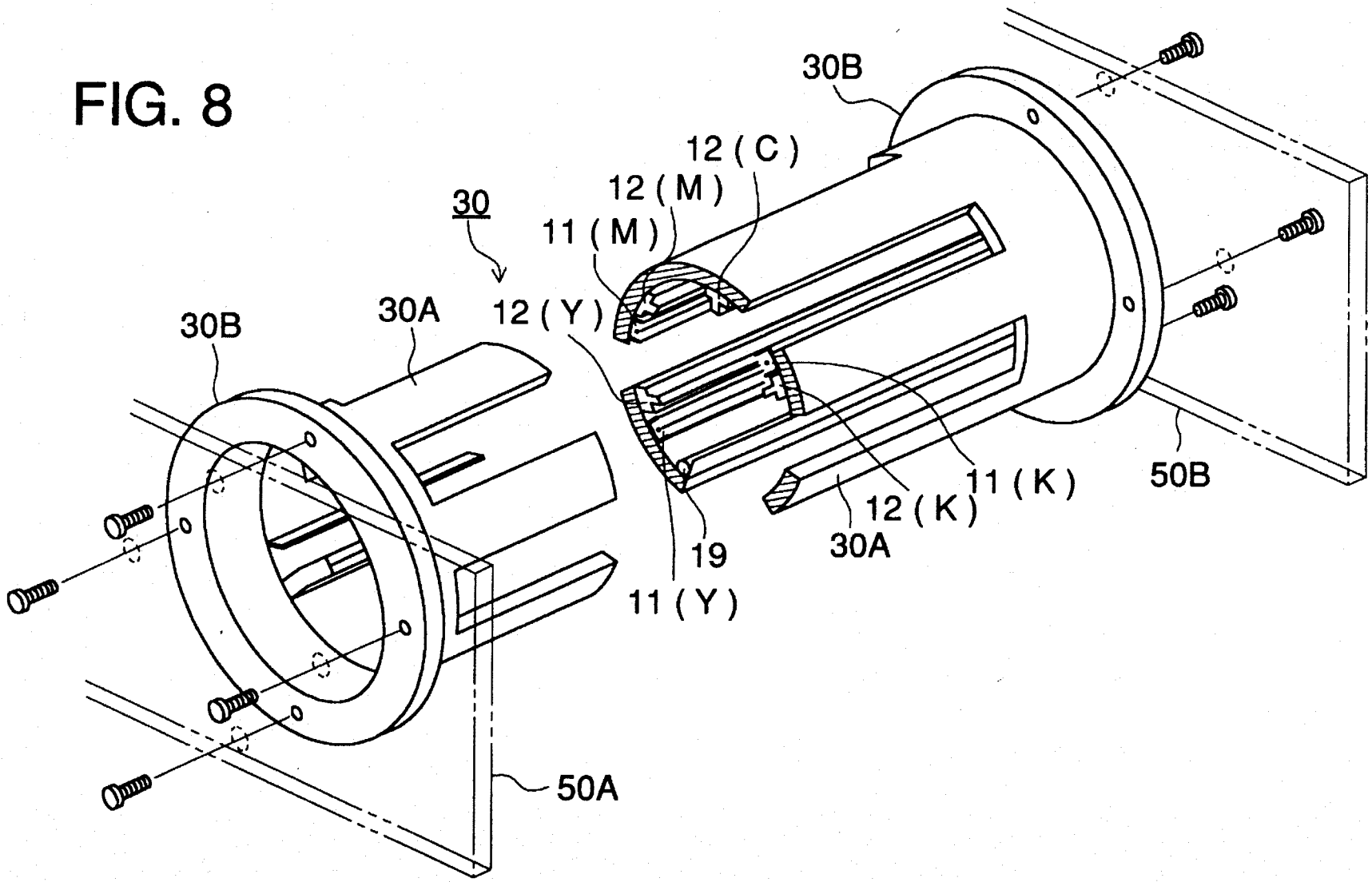
FIG. 8 is a perspective view of the supporting member.

FIGS. 6 through 8 show an embodiment in which the optical exposure system 12 is fixed on the internal surface of the cylindrical member 30. Members having the same function in the former embodiment are provided with the same reference number as that of the corresponding members in the former embodiment.

The numeral 30 is a cylindrical member in which the photoreceptor drum 10 is coaxially incorporated. As shown in FIGS. 2 and 3, the cylindrical member 30 comprises a cylinder section 30A distant with a predetermined space from the circumferential surface of the photoreceptor drum 10 and flanges 30B provided on both ends of the cylinder section 30A.

As shown in FIG. 7(*b*), each optical exposure system 12 is fixed on the internal surface of the cylinder section 30A with wedge-shaped supporting member 31 by means of an adhesive after positional adjustment.

Each charging device 11 is fixed on the internal surface of the cylinder section 30A such that electrode blocks located on both ends of the charging device 11 are fixed with screws. Incidentally, on the internal surface of the cylinder section 30A, it may be possible to fix a cleaning device 19 in place of the charging device 11 or together with the charging device 11. Since each of the charging device 11 and the cleaning device is fixed with screws or the detachable engagement, the replacement work for them can be easily conducted.

As shown in FIG. 8, the cylinder section 30A on which the optical exposure systems 12, the charging devices 11 and the cleaning device 19 are mounted is installed in such a manner that each flange section 30B is fixed to base plates 50A and 50B on the apparatus body with screws so that the cylinder section 30A incorporates the photoreceptor drum 10 therein on the condition that the axis of the cylinder section 30A and the photoreceptor drum 10 agree with each other.

In this embodiment, the optical exposure systems 12, the charging devices 11 and the cleaning device 19 are structured so as to be mounted the internal surface of the cylindrical member 30. Alternately, the following structure may be adopted: That is, only the optical exposure system 12 is mounted on the cylinder section 30A, the charging devices 11 and the cleaning device 19 are mounted on a portion of the image forming member side, for example, on a cartridge in which the photoreceptor drum 10 is accommodated.

In this case, as same as FIG. 4(*a*), the numeral 40 is a cartridge in which the photoreceptor drum 10 is supported with its bearing. As illustrated in FIG. 4(*b*) showing a sectional view along line 4*b*—4*b* in of FIG. 4(*a*), the charging device 11 is inserted from one side of the cartridge 40 and is engaged and fixed in space 40A formed in the axial direction on the circumferential surface of the cartridge 40.

The cartridge 40 is provided with a pair of rail members L1 at symmetrical positions on its circumferential surface and guide members L2 are provided on the apparatus body. The cartridge 40 is mounted on a predetermined image forming position in such a manner that the rail members L1 are inserted in the guide members L2. On the image forming position, the developing sleeve 130 of the developing devices face the circumferential surface of the photoreceptor drum 10 through the cut-out sections provided on the circumferential surface of the cartridge 40.

With the mounting operation to mount the cartridge 40 on the image forming position, an electric connection between the charging devices 11 and a power source, a gear engagement between a gear G1 on a rotational shaft on the photoreceptor 10 and a driving gear G2, and a connection between the cleaning device 10 and a power transmitting system are conducted.

It is possible to replace each charging device 11 and the cleaning device 19 individually. However, if the life cycle of the devices is made equal to that of the photoreceptor drum 10, the cartridge 40 including all of the devices may be replaced with a new one so that a maintenance work may be simplified.

Incidentally, it may be possible to mount the charging devices 11 and the cleaning device 19 separately on the cylindrical member 30 and the cartridge 40.

With the structure mentioned above, an assembling work and a maintenance work such as an inspection work and a replacement work for the image forming member constituting a color image forming section, the plural charging means, the plural image exposure means, the plural developing means and cleaning means can be conducted easily. Further, in the result that those means are mounted on the coaxial cylindrical member, the relative positional relation can be maintained without change for the change in environmental temperature. Still further, since the heat radiating ability of the light source of the image exposure means is enhanced, the registration of the image light can be maintained. As a result, the maintenance work can be conducted easily and a color image forming apparatus in which image quality is stable can be provided.

A preferable embodiment regarding the photoreceptor drum will be explained hereinafter with reference to FIGS. 9 and 12.

As well known, the photoreceptor drum 10 is a cylinder member shaped longer in its axial direction.

Figure 9:
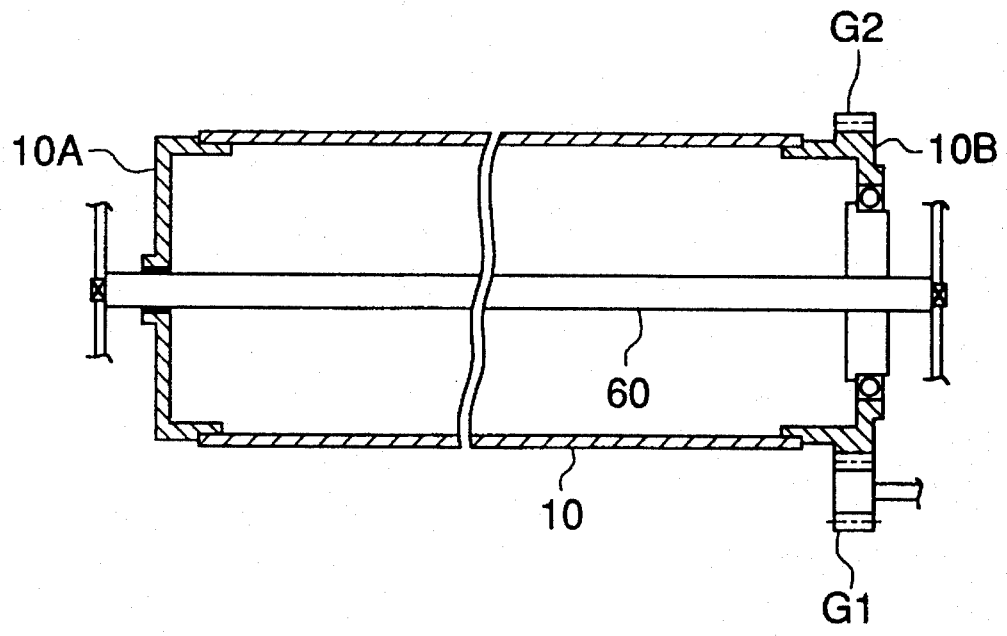
FIG. 9 is a longitudinal sectional view of a photoreceptor.

As shown in FIG. 9, flange members 10A and 10B are integrally fitted on the both ends of the photoreceptor, and the photoreceptor drum 10 is rotatably supported with bearings around a drum shaft 60 extended between base plates of the apparatus.

On the flange member 10B is integrally formed a gear G2 capable of engaging with a driving gear G1 provided on the apparatus body side so that the gear G2 is driven and rotated in a predetermined direction by the driving source of the apparatus body side.

Figure 10:
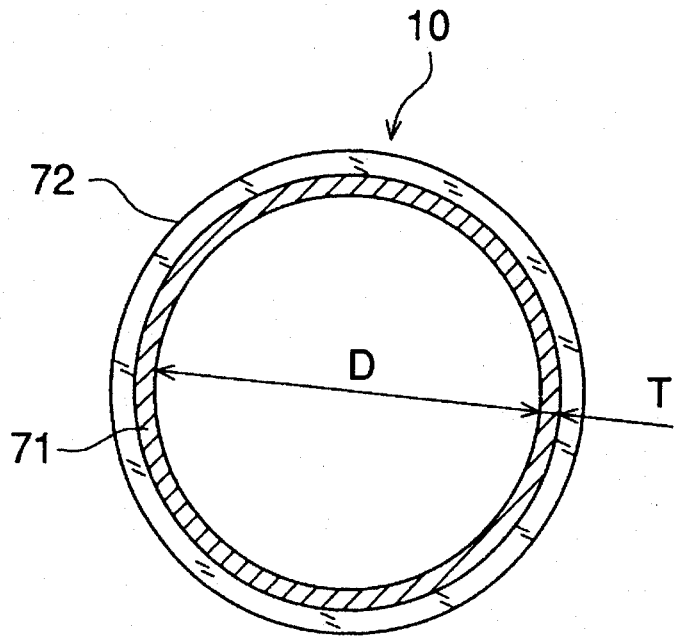
FIG. 10 is a transverse sectional view of the photoreceptor.

As shown in the transverse sectional view of FIG. 10, the photoreceptor is composed of a drum base member 71 made of a metal or a hard synthetic resin and a thin organic photosensitive layer 72 coated with a thickness of 10 μm to 100 μm on the drum base member 71. With the mechanical strength of the drum base member 71, the true roundness and the true straightness of the photosensitive layer 72 is maintained.

The plural charging devices 11, in order to arrange the plural optical exposure system 12, the plural developing devices 13, the transfer device 14A, the charge eliminating device 14B and the cleaning device 19 around the outer circumferential surface of the photoreceptor drum 10, the diameter (D) of the drum base member 71 is needed to be larger than 100 mm. On the other hand, in order to make the apparatus smaller and lighter and with the consideration about the fluctuation of the registration due to deformation caused by the driving torque of the photoreceptor drum and the pressure contact of both the developing device 13 and the cleaning device 19 or due to the change in circumferential speed (line speed on the circumferential surface) caused by the thermal expansion in the time of temperature increasing, the inside diameter (D) of the drum base member 71 is preferably needed smaller than 200 mm.

In view of the above points, the present inventors determined that the range of the inside diameter (D) of the drum base member 71 suitable for the actual use is 100 mm to 200 mm, conducted the great number of experiments with regard to the thickness (T) of the drum base member 71 necessary to guarantee the abovementioned mechanical strength in the above range of the inside diameter, and examined by comparing the image quality formed by the use of the drum base member 71 whose thickness was varied.

Figure 11:
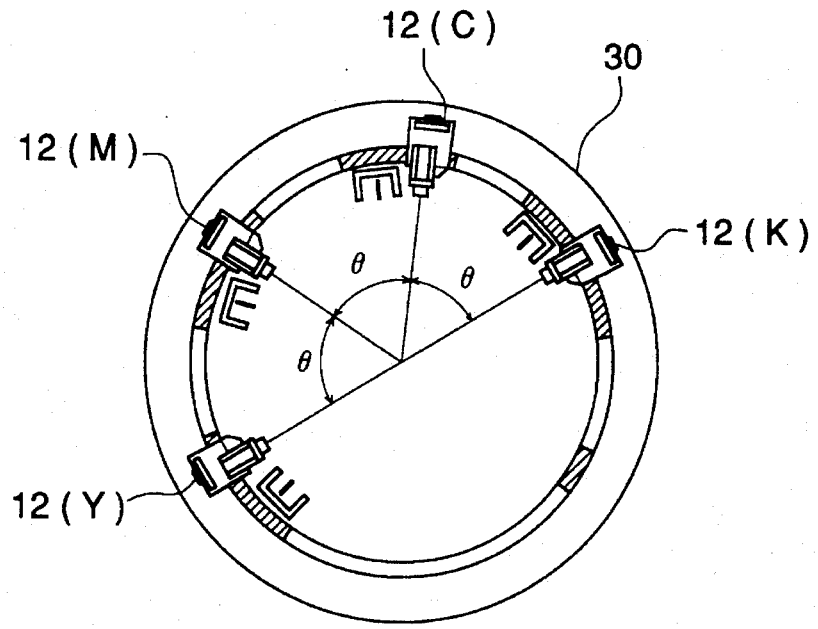
FIG. 11 is a schematic diagram showing an arrangement of an exposure optical system.

In the experiment, with the consideration about the strength necessary for the drum base member and the manufacturing precision for the circumferential surface of the drum base member, the drum base member 71 was made of aluminum. For the purpose of refraining the fluctuation in registration caused by thermal expansion of the drum base member 71 as small as possible, the plural optical exposure systems were supported on the common supporting member shaped in the form of a cylinder as shown in FIG. 11 in such a manner that each of the optical exposure systems was mounted on the cylindrical supporting member which was coaxial with the drum, arranged with the equal center angle θ in relation to the drum and with the equal distance from each other on the circumference of the cylindrical supporting member, whereby each of the optical exposure systems was structured to equally receive the influence caused by thermal expansion.

Figure 12:
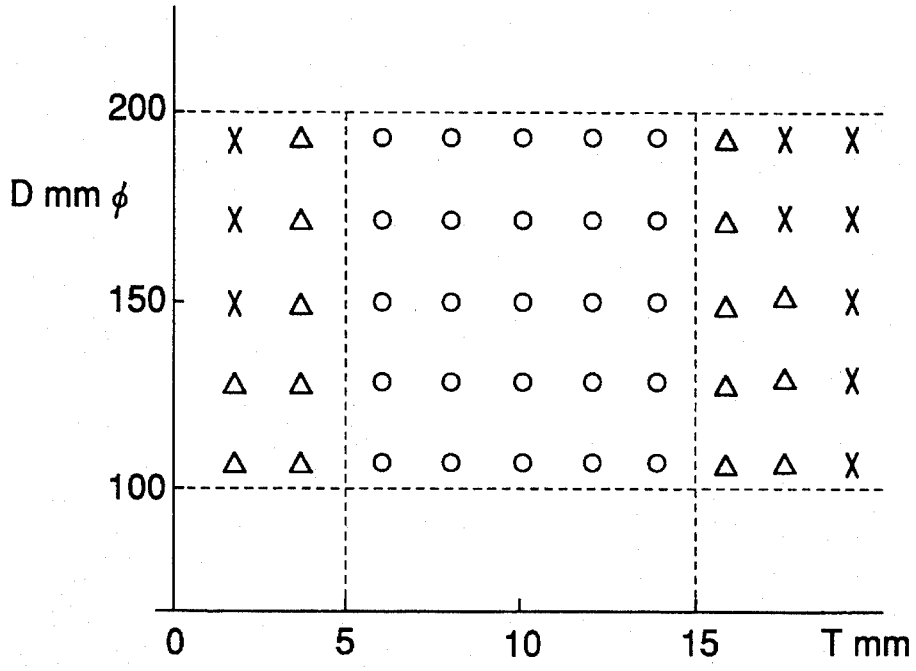
FIG. 12 is a graph showing a change in image quality depending on the inside diameter and the thickness of the base member of the photoreceptor drum.

As shown in the graph in FIG. 12, as a result that the great number of drum base members differing in diameter (D) and thickness (T) were manufactured on trial basis and the comparison tests were conducted for them, in the case that the thickness (T) of the drum base members 71 whose inside diameter (D) were 100 mm to 200 mm was selected from the range of 5 mm to 15 mm, distortion and deformation were not observed on the photoreceptor drum 10, the driving torque was suitable, and driving fluctuation was not observed. Further, since each of the optical exposure systems was equally received the influence of thermal expansion or shrink caused by the environmental temperature change, it was confirmed that high quality image marked with circle (○) can be formed stable. Incidentally, mark triangle (Δ) means that a slightly low quality image was formed, mark (x) means that a low quality image was formed.

An embodiment regarding the incident angles of image light from the optical exposure system on the drum surface will be explained hereinafter with reference to FIG. 13.

Each of the optical exposure systems 12 is inserted and fixed in the slit provided on the cylinder section 30A of the coaxial cylindrical supporting member 30, or fixed with a regulating member on the internal circumferential surface of the cylinder section 30A. Each of the charging devices 11 is directly fixed on the internal circumferential surface of the cylinder section 30A.

The supporting member 30 on which the optical exposure systems 12 and the charging devices 11 are mounted is supported with flanges 30B provided on its both ends between base plates of the apparatus body so that the positional relation between the supporting member 30 and the photoreceptor drum is determined.

On the other hand, each of the developing devices is inserted into cut-out holes provided on the cylinder section 30A in the horizontal direction, and biased in the direction toward the photoreceptor drum 10 so that the positional relation between the developing devices and the photoreceptor drum are set.

Figure 13:
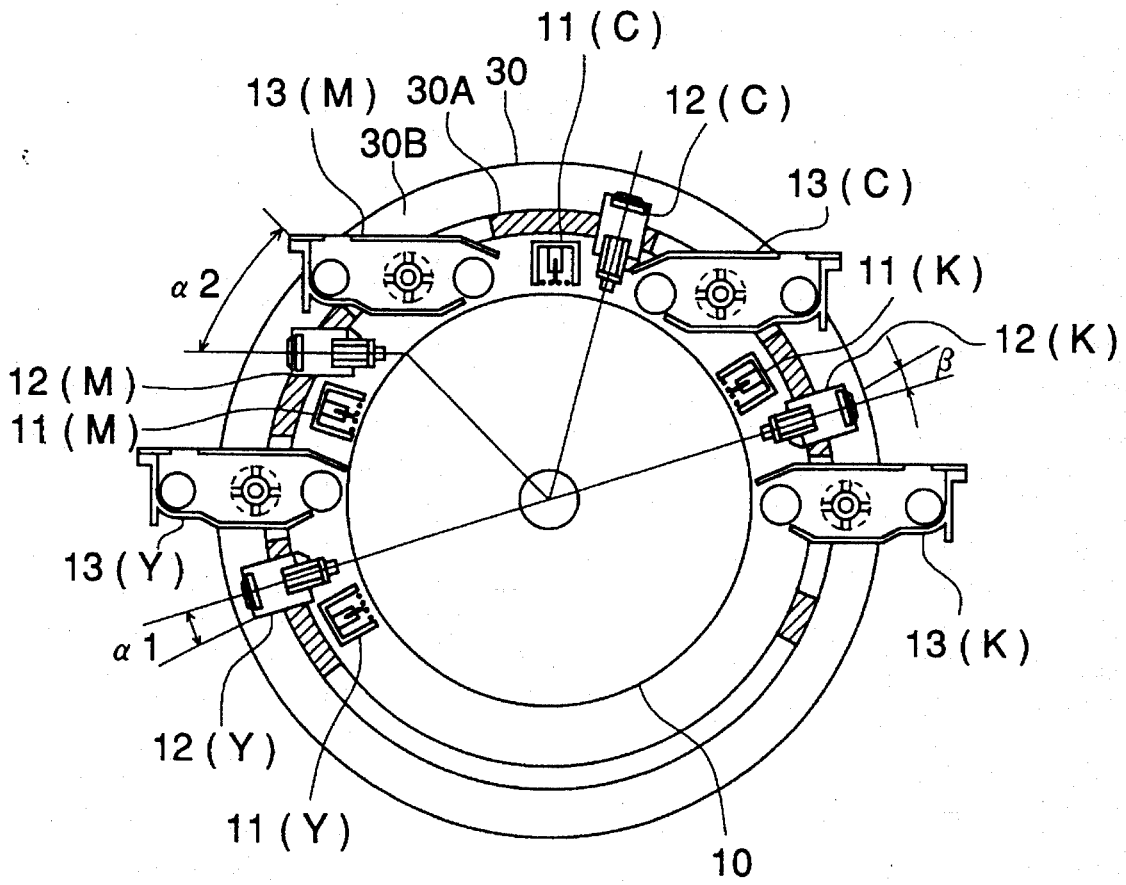
FIG. 13 is a schematic diagram showing an arrangement of an exposure optical system.

In the time of making a lay-out in which each of the optical exposure systems is arranged so as to face the photoreceptor drum 10, in some optical exposure systems which has not a fear to interfere with a neighboring developing device 13 or a neighboring charging device 11, for example as the optical exposure system 12(C) shown in FIG. 13, an optical axis of image light is perpendicular to the drum surface, that is, the incident angle is zero (0°). On the other hand, in some other optical exposure systems which has a fear to interfere, as examples of the optical exposure systems 12(Y), 12(M) and 12(K), the incident angles are inclined by α1, α2 and β respectively so that the optical exposure systems 12(Y), 12(M) and 12(K) are arranged in parallel to the neighboring developing devices 13(Y), 13(M) and 13(K) respectively.

With the inclination of the incident angles, the spaces occupied by the optical exposure systems in the circumferential direction can be appreciably reduced. As a result, it is not necessary to shape the developing device 13 in the complicated configuration such as the bent or stepped body as the developing device 13 (M) or 13 (C) shown in FIG. 1. All of the developing device 13 can use a flat or horizontal body which is preferable for the agitation or the conveyance for the developing agent and there is no fear that the developing agent spills out. It is easy to produce the flat or horizontal body. Also, it is possible to make machinery parts common for all developing devices.

With regard to the inclined angles Alfa and gamma of the incident angles of the optical exposure systems 12, in order to refrain spreading of the beam of the optical exposure system projected on the drum surface, it may be preferable to make the inclined angles Alfa of the optical exposure systems 12(Y), 12(M) and 12(C) corresponding to yellow, magenta and cyan images not larger than 45', on the other hand, since high resolution is required for black image, it may be preferable to make the inclined angles gamma of the optical exposure system 12(K) not larger than 20'. With this arrangement, it was confirmed that high quality image sufficient for practical use can be obtained.

With above embodiments, the troubles such as the distortion or the deformation of the photoreceptor drum caused by the pressure contact of the plural developing devices can be solved. The high precise superimposition of plural toner images differing in color during a single rotation of the photoreceptor drum can be realized. Since the spaces occupied by the plural optical exposure systems are used effectively, it is possible to make the photoreceptor drum small. As a result, it is possible to provide the effective color image forming apparatus for practical use with which the apparatus body is compact and high quality image is formed stably as high speed.

Next, an embodiment with regard to the image exposure means and the developing means will be explained hereinafter.

Figure 34:
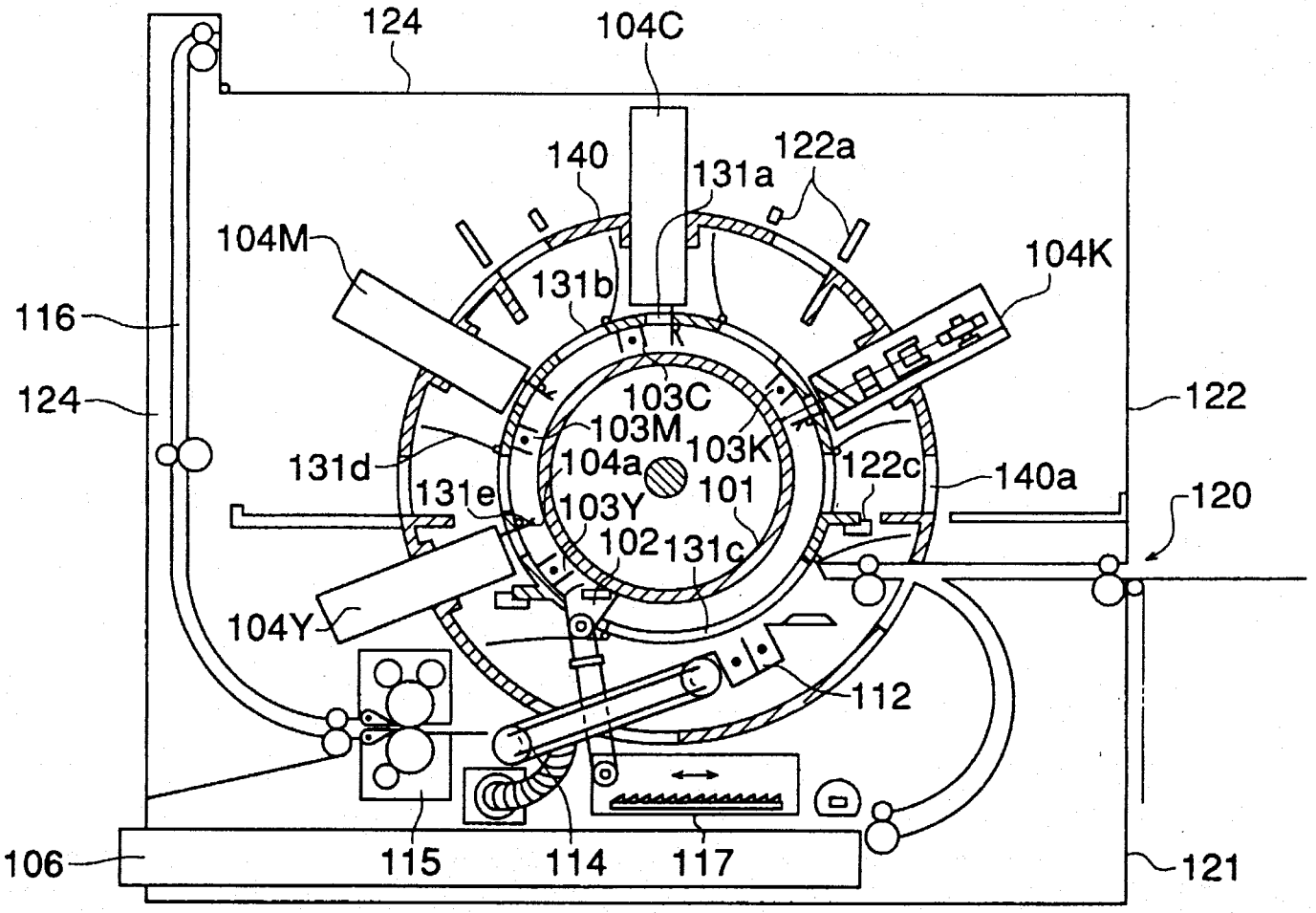
FIG. 34 is a sectional view showing a construction of a color image forming apparatus in the condition that the developing devices are dismounted.
Figure 35:
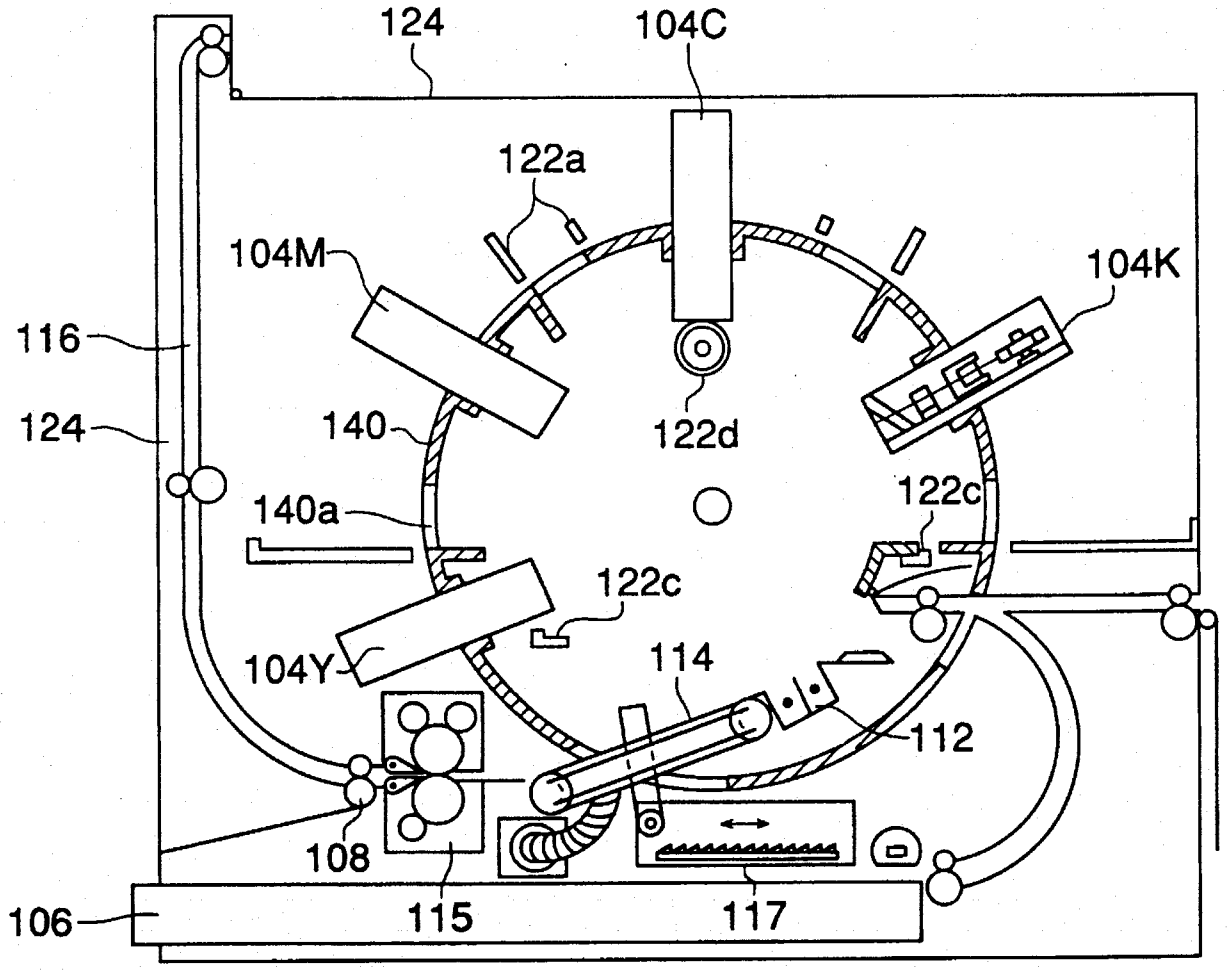
FIG. 35 is a sectional view showing a construction of a color image forming apparatus in the condition that the developing devices and the unit frame are dismounted.
Figure 36:
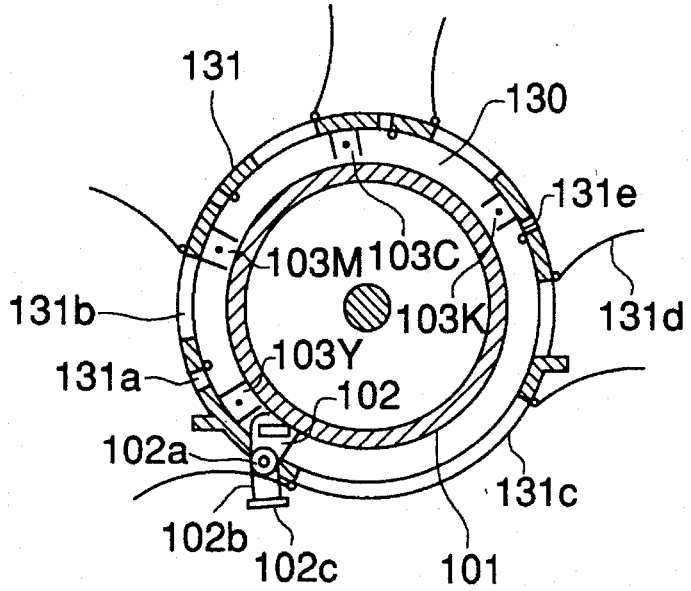
FIG. 36 is a sectional view of the unit frame in the condition that the unit frame is dismounted from the apparatus.
Figure 37:
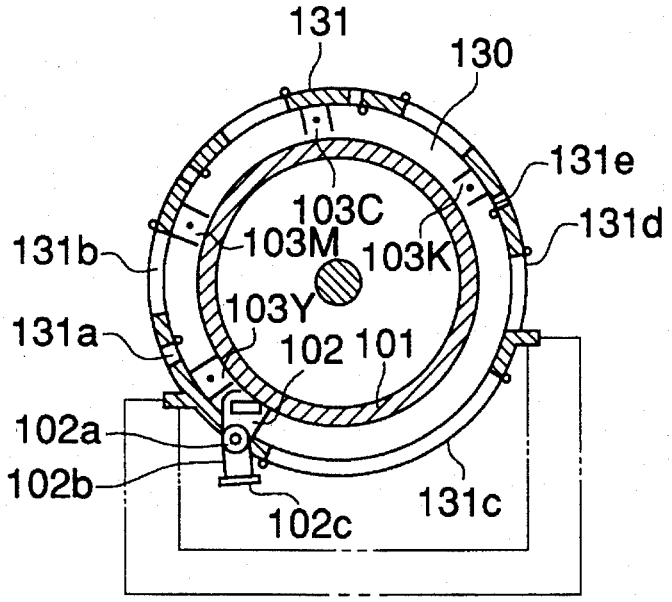
FIG. 37 is a sectional view of the unit frame in the condition that the unit frame is dismounted from the apparatus and the rotatable lid is closed.

In the color image forming apparatus in this embodiment, the image exposure means 104Y to 104K are mounted radially on the cylindrical supporting member 140 in which the image forming member 101 (photoreceptor drum) is coaxially incorporated. With this structure, the driving timing of the image exposure means 104Y to 104K are precisely adjusted easily so as not to cause color deviation, thereby forming a clearer superior color image easily without color deviation. Further, when the body section of the supporting member on which the image exposure means 104Y to 104K are mounted is shaped in the form of a partial cylinder as shown in FIGS. 14, 16, 18, and 28 through 30 or in the form of a cylinder as shown in FIGS. 33 through 35, and the center angle between the neighboring image exposure means among three sets of the image exposure means 104Y to 104K is equal to each other, the adjustment of the driving timing of the image exposure means 104Y to 104K and the formation of the clearer superior color image can be conducted more easily.

Figure 14:
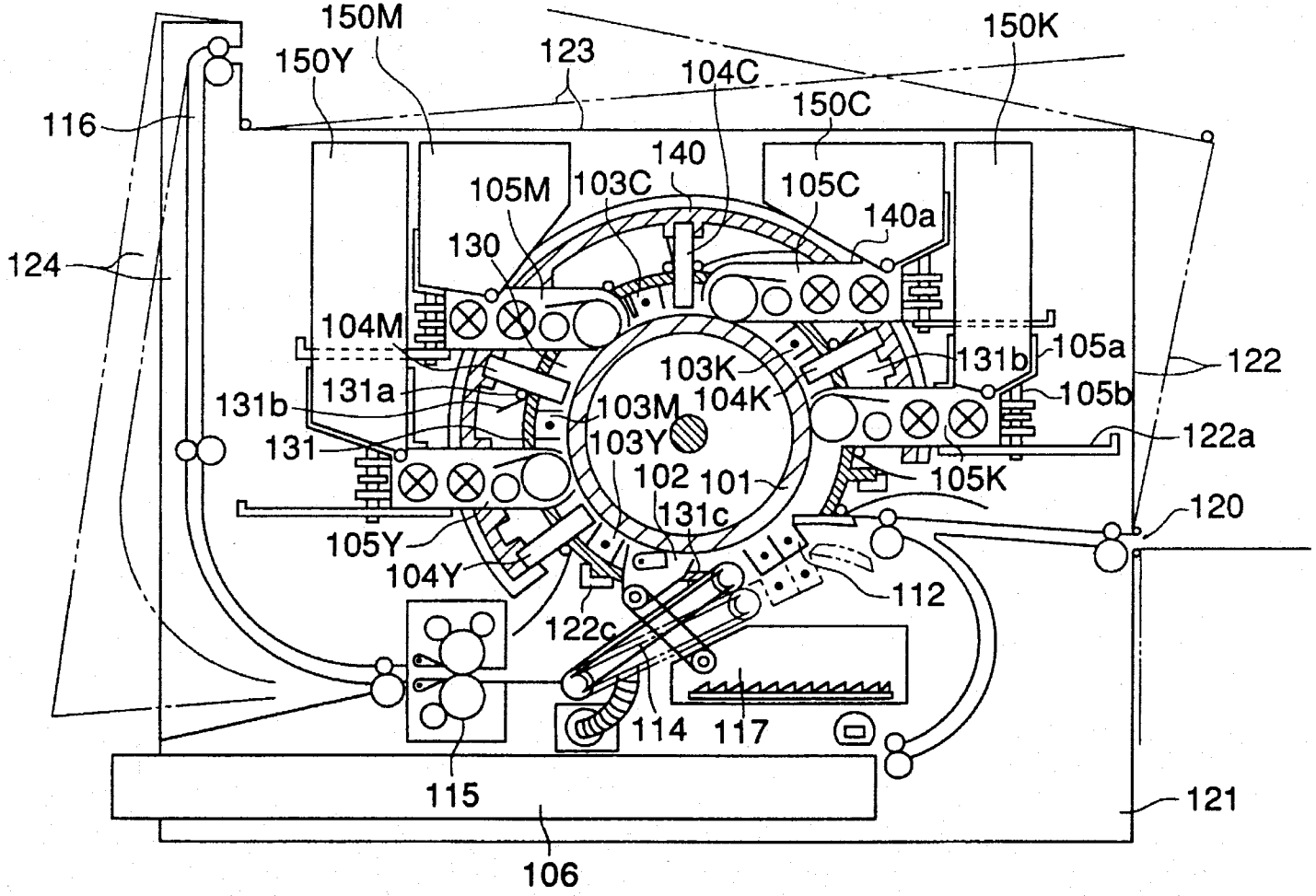
FIG. 14 is a sectional view showing a construction of a color image forming apparatus of another embodiment of the present invention.
Figure 28:
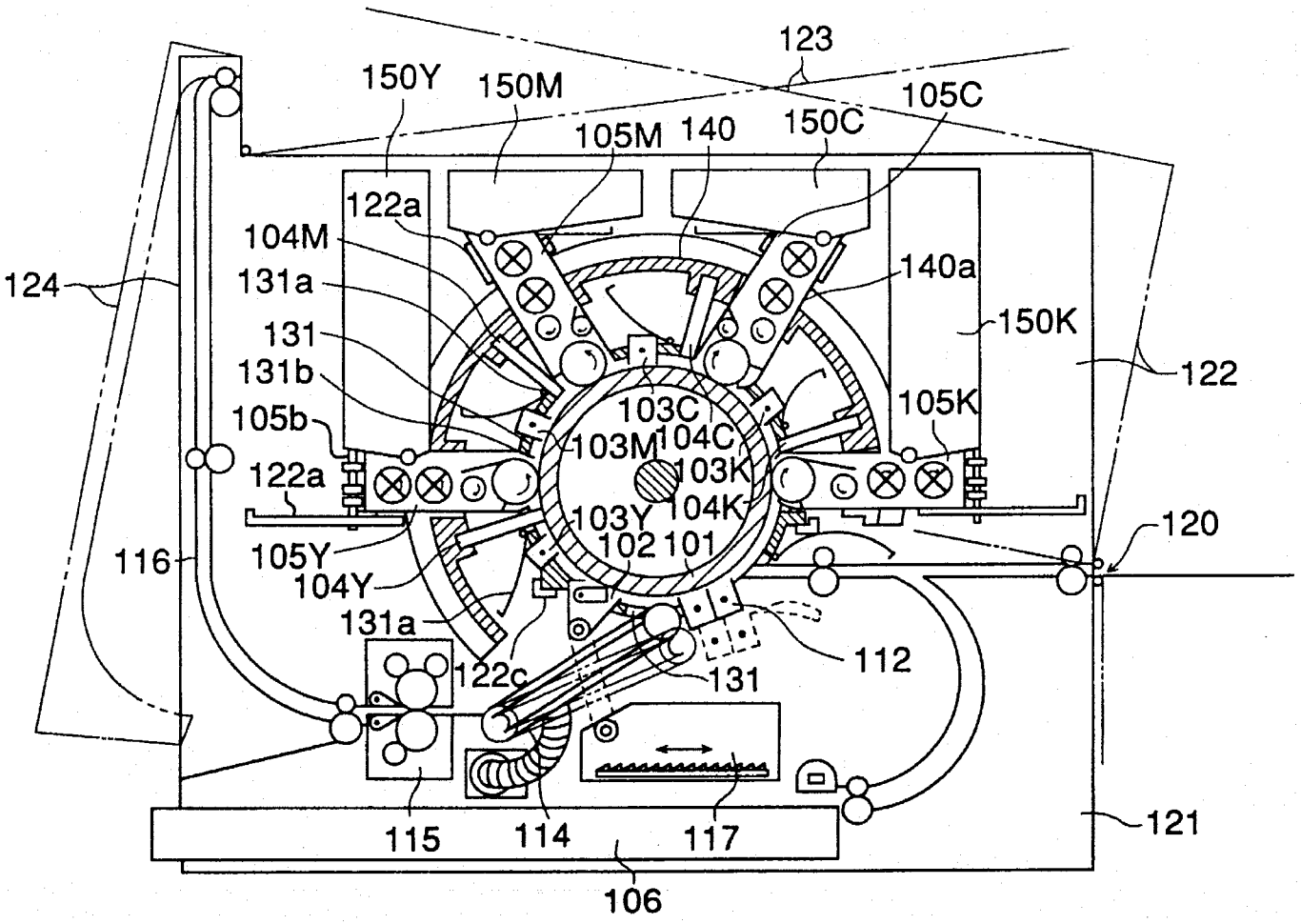
FIG. 28 is a sectional view showing a construction of a color image forming apparatus of another embodiment of the present invention.

In the examples shown in FIGS. 14 and 28, in order to construct the apparatus in compact, a light emitting element-aligned member is used as the image exposure means 104Y to 104K. The light emitting element-aligned member is composed of one of FL, EL, PL and LED in which light emitting elements are aligned in parallel to the axis of the image forming member 101 or a combination of a line-shaped light source and one of LISA, PLZT and LCS in which elements having a shutter function are aligned in a line and a selfoc lens as an equal image forming element. The above type image exposure means 104Y to 104K does not include any movable member so that the supporting member 140 may not be vibrated. Accordingly, the body section of the supporting member may be shaped in the form of the partial cylinder. With the partial cylinder, the apparatus body 120 may be constructed in the form of a separable structure in which a jammed sheet occurred on the sheet conveying passage adjoining the image forming member 101 can be removed easily.

Figure 33:
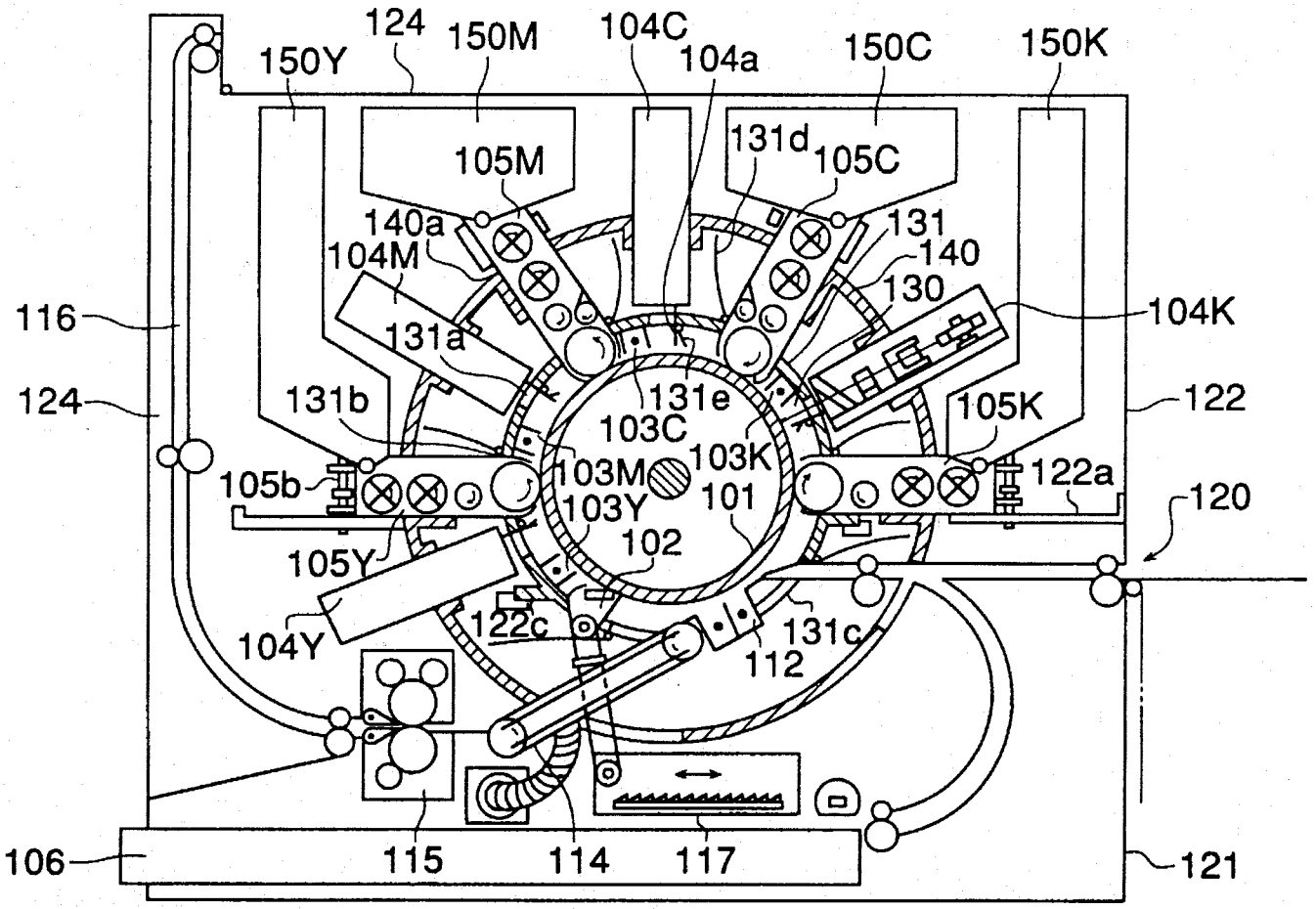
FIG. 33 is a sectional view showing a construction of a color image forming apparatus of another embodiment of the present invention.

In an example shown in FIG. 33, in order to form a delicate color image, a laser beam scanner is used as the image exposure means 104Y to 104K which can increase the density of dots easily and has a deeper focal depth. In the laser beam scanner, a laser beam generated from a semiconductor laser is deflected by a deflecting means such as a polygonal mirror and a galbano mirror and is projected onto the image forming member 101 through a F/θ lens and a cylindrical lens. Since, in the laser scanner, image exposure is projected through a relatively longer optical path and the deflecting means moving rotatively or reciprocatively at high speed is likely to vibrate the fixing member, it may be preferable to shape the body section of the supporting on which the lens and the laser beam deflecting means are integrally mounted in the form of a cylinder which hardly be vibrated.

In the color forming apparatus shown in FIG. 14, in order to conduct the removal of jammed transfer sheet and the toner replenishment for developing devices 105Y to 105K easily, an apparatus body is structured in the form of a separable construction composed of a lower frame 121 in which a transfer sheet conveying passage from the mounting section of a sheet feed cassette 106 to the outlet section from the fixing device 115 and a lower half portion of a manual feed transfer sheet passage are provided; an upper frame 122 openable in the clockwise direction for the lower frame 121 around a hinge provided on the both sides of the manual feed opening; an upper cover 123 openable in the unticlockwise direction, the upper cover 123 further adapted to be used as a delivery tray; and a discharging passage cover 124 openable in the clockwise direction around an upper roller shaft, working as the rotation axis, of conveying pressing rollers at the outlet of a discharging passage 116 so as to open the discharging passage 116. The separable construction is not limited to the above embodiment. For example, the upper frame 122 may be openable in the counterclockwise direction for the lower frame 121 alternatively around the upper roller of the conveying pressing rollers 108 at the outlet section of the fixing device 115 on the condition that the discharging passage cover 124 was opened in advance, or the hinge of the upper cover 123 is provided at the opposite side of the above embodiment and the upper cover 123 may be openable in the clockwise direction.

With the separable construction of the apparatus body 120 as mentioned above, when jam trouble occurs on the transfer sheet passage before the outlet of the fixing device 115, the jammed sheet can be easily removed by opening the upper frame 122. When jam trouble occurs on the discharging passage 116, the jammed sheet can be easily removed by opening the discharging passage cover 124. Also, by opening the upper cover 123, the following operations can be conducted. The toner replenishment is conducted for toner replenishing containers 150Y to 150K connected with the upper rear section of the developing devices 105Y to 105K provided respectively in close proximity to the right and left side surfaces and an upper slant surfaces of the outer circumferential surface of the image forming member 101. The toner replenishing containers 150Y to 150K detachably downwardly fitted into the inside of replenishing container supporting guides 105*a* provided to the developing devices 105Y to 105K can be replaced. Further, the developing devices 105Y to 105K can be drawn out along the developing device supporting guide 122*a* provided on the upper frame 122 or developing unit frame supporting guide 122*b* in the embodiment shown in FIG. 10 to the outside of the circumferential surface of the supporting member 140 so that the developing devices 105Y to 105K can be dismounted and replaced with a spare one. Since the toner can be replenished easily for the developing devices 105Y to 105K, the developing devices 105Y to 105K may be shaped in small size. Also, with the small size developing device, the image forming member may be shaped in small size. As a result, the color image forming apparatus can be manufactured in small size at low cost.

The developing devices 105Y to 105K are guided in substantially the horizontal direction by the developing device supporting guide 122*a* provided on the upper frame 122 and the inspection hole 140*a* provided on the periphery wall of the supporting member 140. When the toner replenishing containers 150Y to 150K are lifted up, the developing devices 105Y to 105K are separated from the condition shown in FIG. 14 in which spacer rollers provided rotatably on both sides of the developing roller are brought in contact with the image forming member 101 and set rods 105*b* of the developing devices 105Y to 105K which are engaged with the developing device supporting guides 122*a* are moved upward by the spring force and are released from the engagement with the developing device supporting guides 122*a*. Accordingly, the developing devices 105Y to 105K can be guided so as to be separated from the image forming member in the horizontal direction by the developing device supporting guide 122*a* and the inspection hole 140*a* and can be drawn out of the periphery wall of the fixing member 140. Thereafter, when the developing devices 105Y to 105K are lifted up, the developing devices 105Y 105K can be dismounted from the upper frame 122. When the developing devices 105Y to 105K are mounted to the position shown in FIG. 14, the mounting can be conducted by the reverse operations of the above operations.

Figure 16:
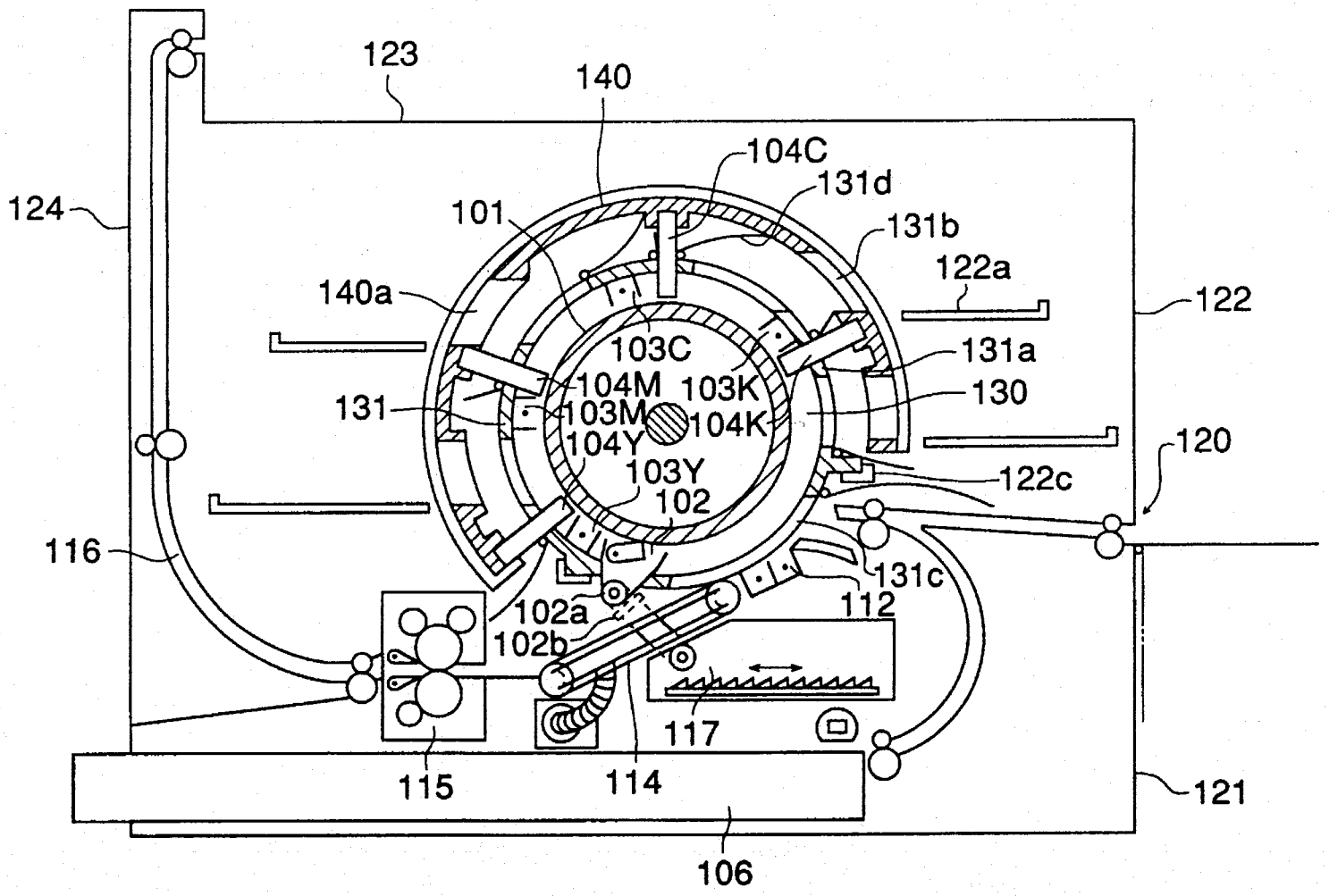
FIG. 16 is a sectional view showing a construction of a color image forming apparatus in the condition that the developing devices are dismounted.
Figure 17:
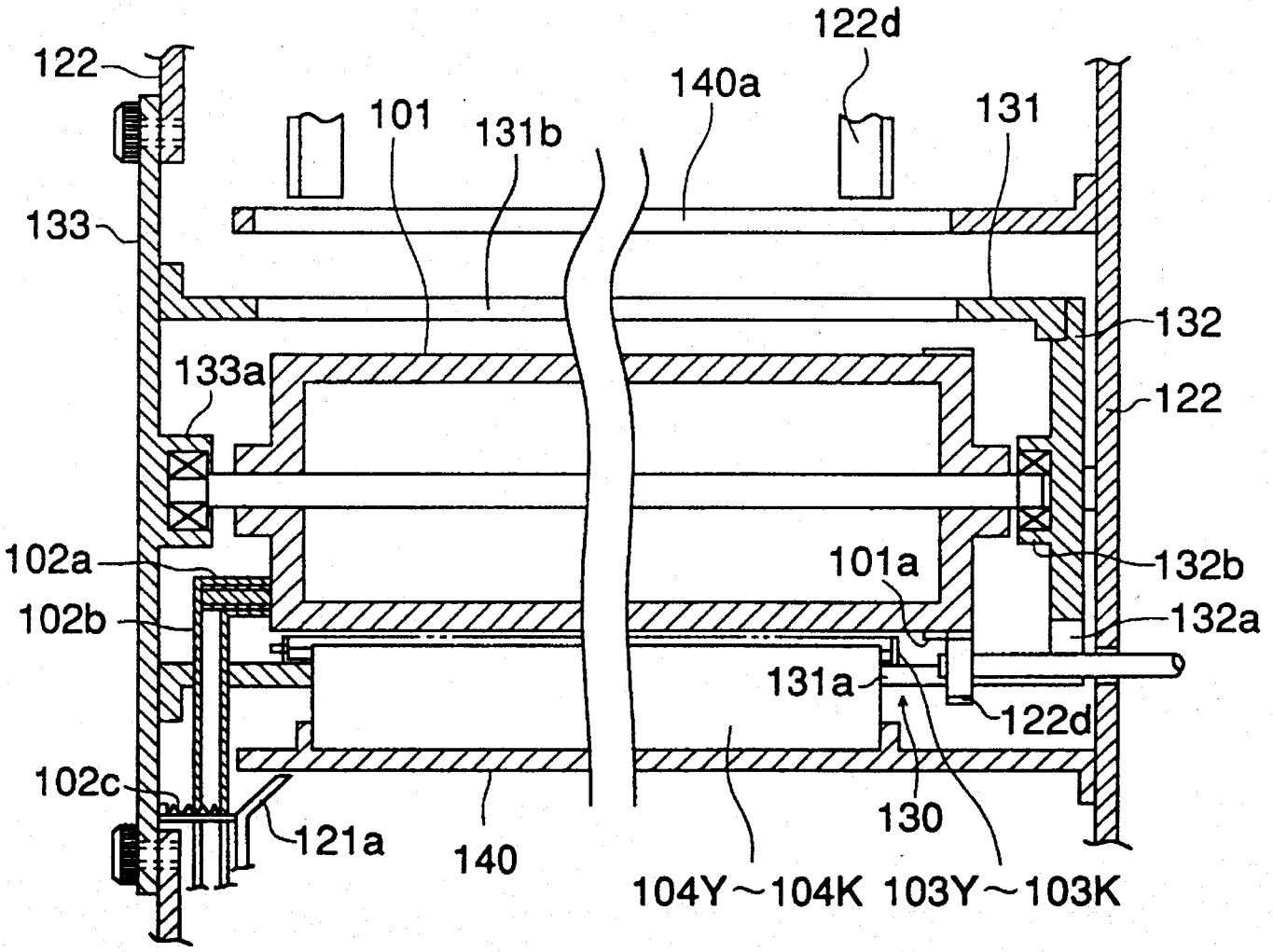
FIG. 17 is a partial sectional view of the apparatus shown in FIG. 14 in the condition that the developing devices are dismounted.
Figure 18:
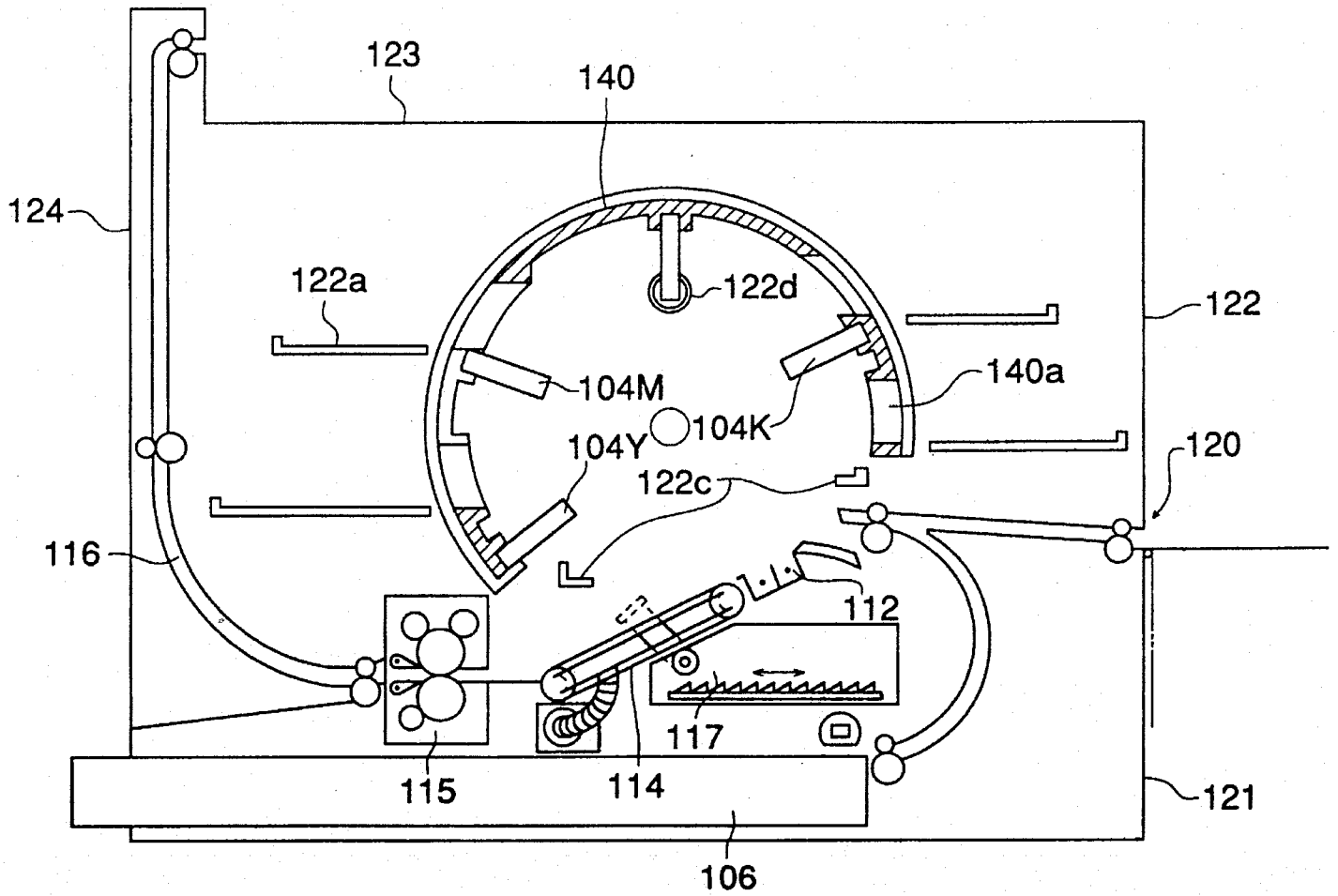
FIG. 18 is a sectional view showing a construction of a color image forming apparatus in the condition that the developing devices and the unit frame are dismounted.
Figure 19:
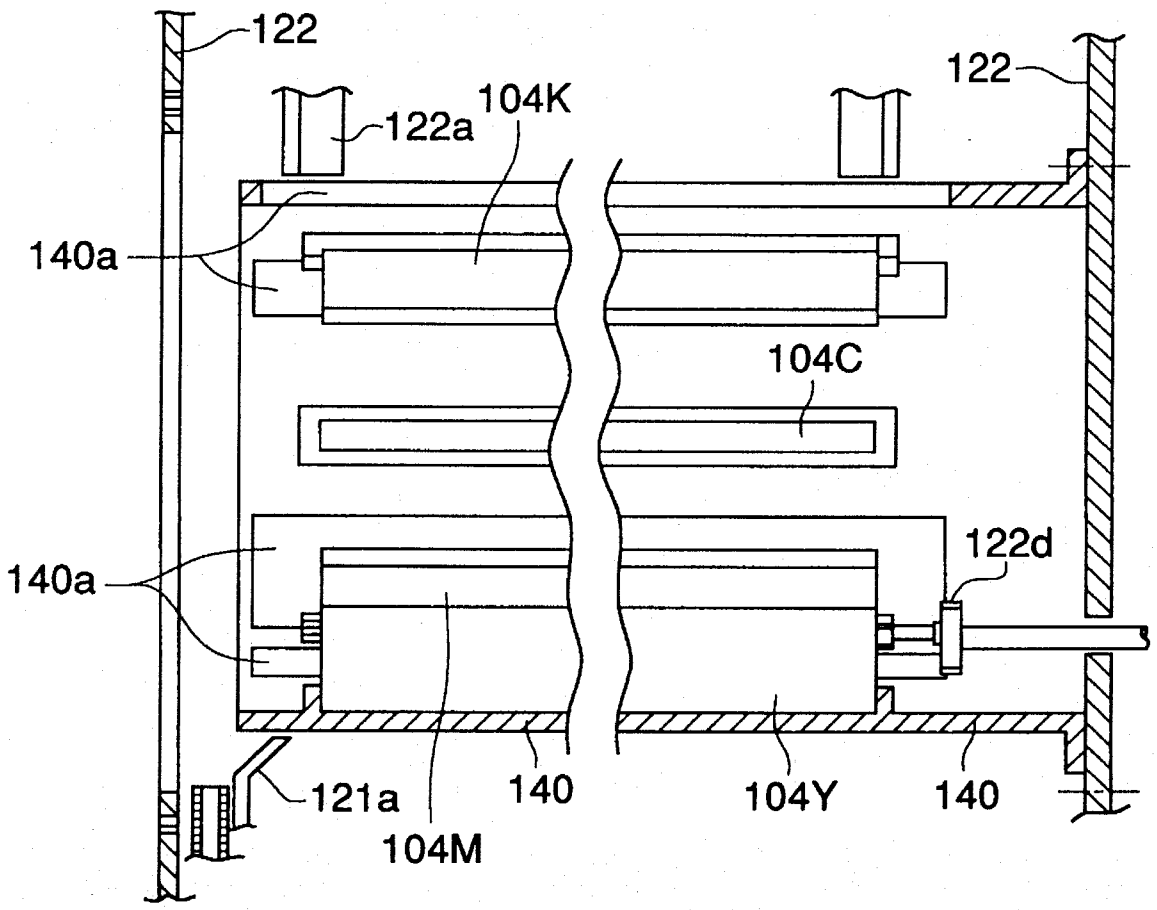
FIG. 19 is a partial sectional view of the apparatus shown in FIG. 14 in the condition that the developing devices and the unit frame are dismounted.
Figure 20:
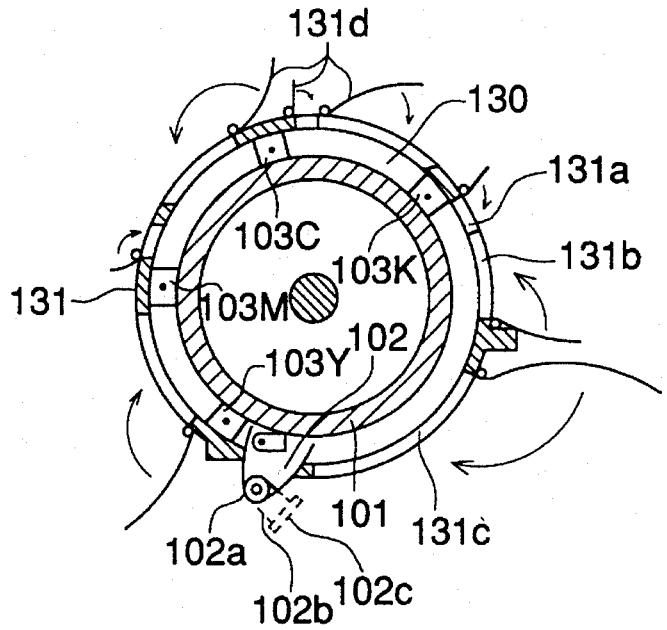
FIG. 20 is a sectional view of the unit frame in the condition that the unit frame is dismounted from the apparatus.
Figure 21:
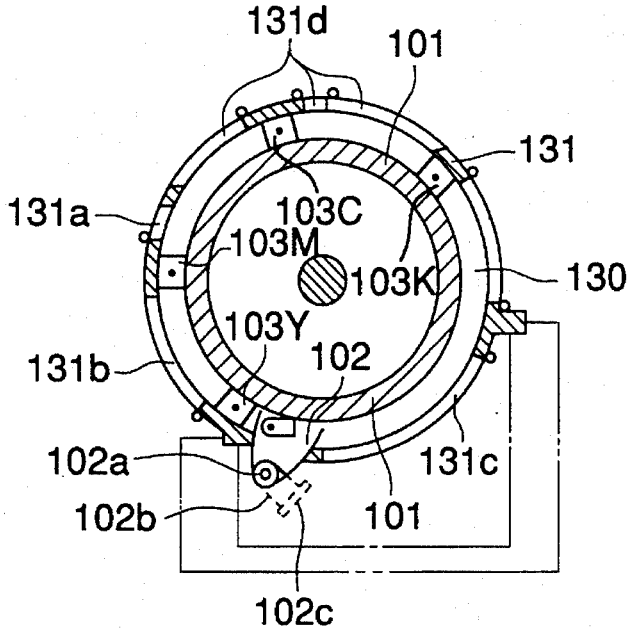
FIG. 21 is a sectional view of the unit frame in the condition that the unit frame is dismounted from the apparatus and the rotatable lid is closed.

FIG. 16 shows the condition after the toner replenishing container 150Y to 150K was dismounted from the developing devices 105Y to 105K shown in FIG. 14. FIG. 16 also shows the condition that a construction integrally liking from a guide for the transfer device 112 to a conveyor 114 is rotated clockwise around the shaft of a fixing device-side driving roller of the conveyor 114 in order to dismount an unit frame 130 supporting the image forming member 101 from the upper frame 122, and the integrally linked construction is shifted outside the periphery wall of a unit frame so as not to interfere the dismounting of the unit frame 130. The operation to rotate the transfer device 112 so as to separate it from the photoreceptor 101 is conducted not only in the case that the unit frame 130 is dismounted, but also in the case that a jammed sheet is removed when a jamming trouble occurs on the sheet conveying passage adjacent to the image forming member 101 as mentioned above.

Figure 23:
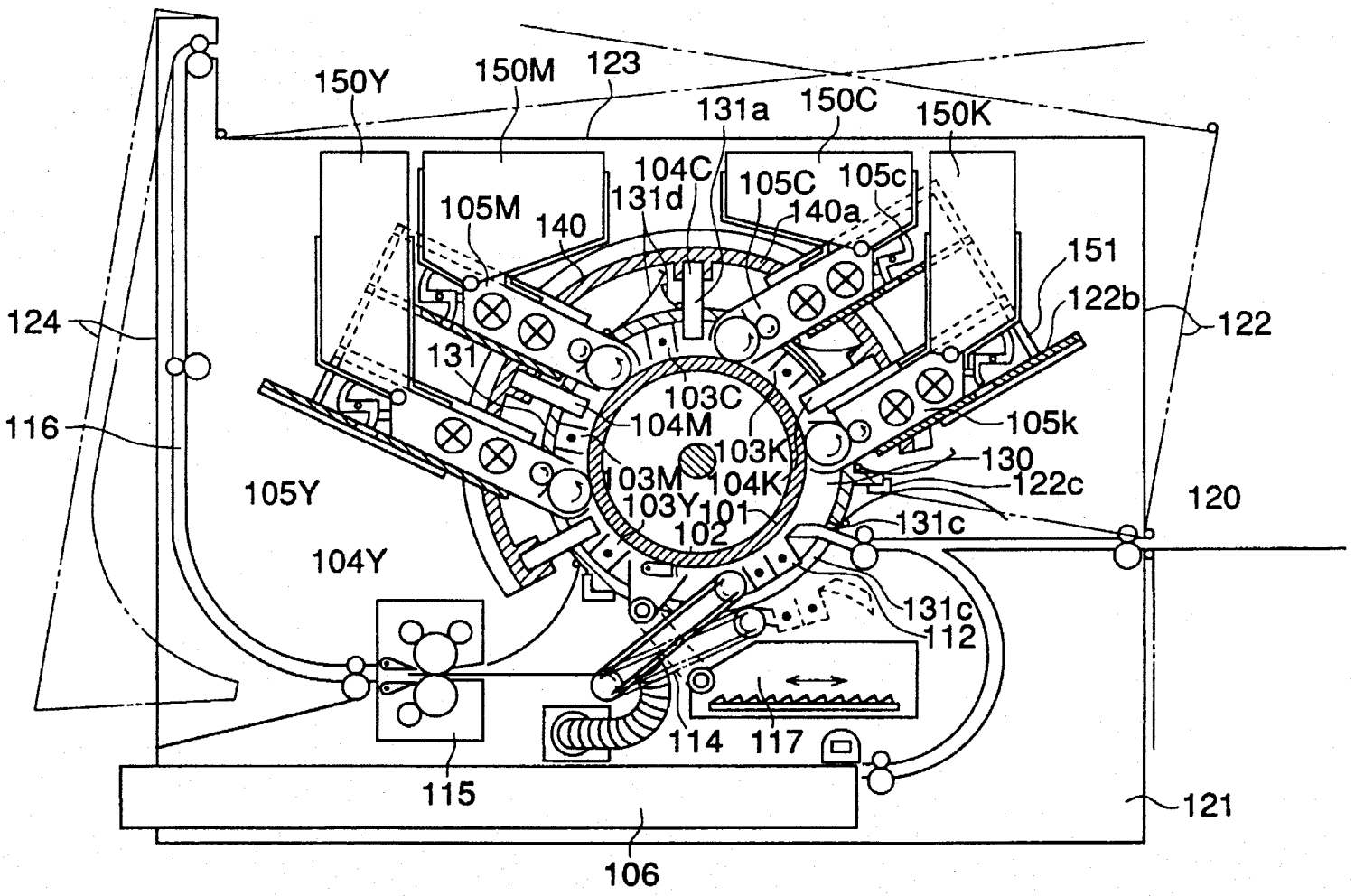
FIG. 23 is a sectional view showing a construction of a color image forming apparatus of another embodiment of the present invention.

With regard to the developing devices 105Y to 105K shown in FIG. 23, the developing devices 105Y and 105M positioned upper and lower on the left side of the image forming member 101 and the developing devices 105C and 105K positioned upper and lower on the right side are incorporated in the developing device unit frames 151 respectively. When the developing device unit frames 151 is moved substantially in parallel to the image exposure means 104M and 104K positioned between the upper and lower developing devices while being guided by the developing device unit frame supporting guide 122*b* provided on the upper frame 122 and the developing device inspection hole 40*a* of the supporting member 140, the upper and lower developing devices 105Y and 105M or 105C and 105K take as a singe body the working position on which the spacer roller of each developing device is brought in pressure contact with the outer circumferential surface of the image forming member or the retracted position on which the developing devices are retracted from the working position to the outside of the periphery wall of the supporting member 140. When the toner replenishing containers 150Y to 150K are lifted up from the working condition shown in FIG. 10 and dismounted from the developing devices 105Y to 105K, developing device locking hook 105*c* is released from being pressed by the corresponding toner replenishing containers 150Y to 150K and engages with the floor plate of the developing device unit frame 151 by spring force so that the developing devices 105Y to 105K are integrally combined with the developing device unit frame 151. Then, after the developing device unit frame 151 is drawn out until the developing devices 105Y to 105K are removed from the periphery wall of the supporting member 140, when the developing device unit frame 151 is further lifted up to the outside of the upper frame 122, the developing devices 105Y to 105K can be dismounted.

Figure 24:
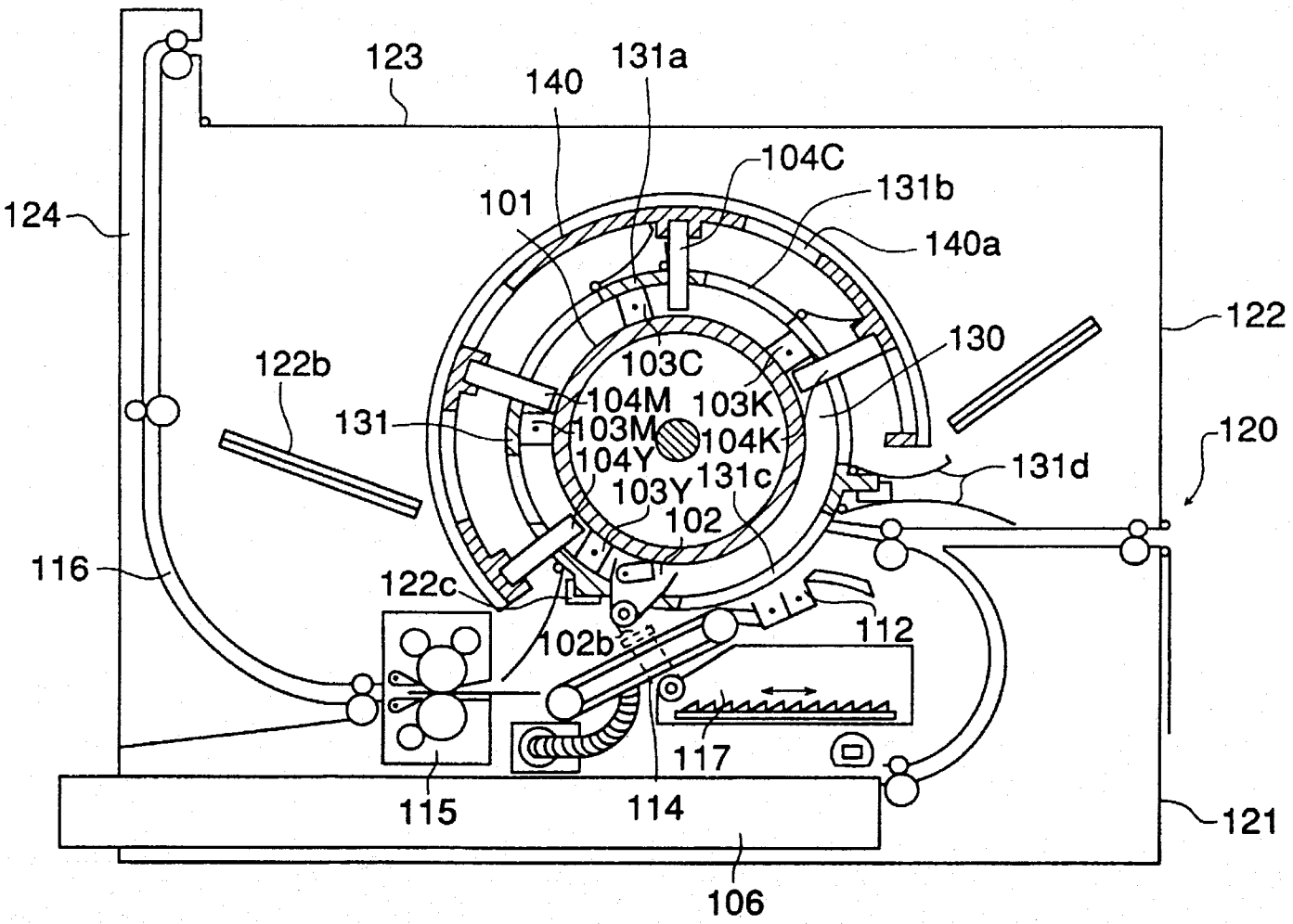
FIG. 24 is a sectional view showing a construction of a color image forming apparatus in the condition that the developing devices are dismounted.
Figure 25:
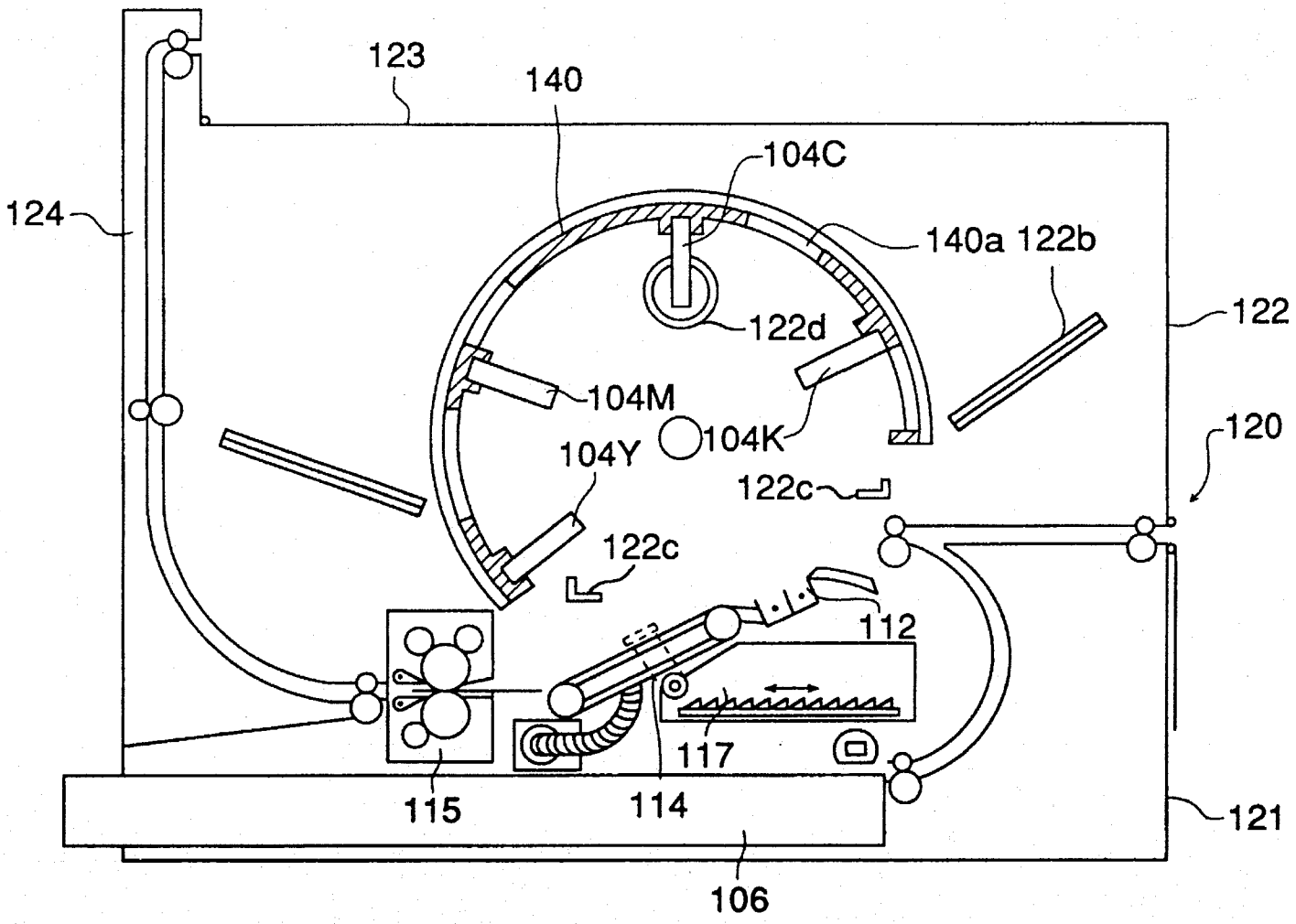
FIG. 25 is a sectional view showing a construction of a color image forming apparatus in the condition that the developing devices and the unit frame are dismounted.
Figure 26:
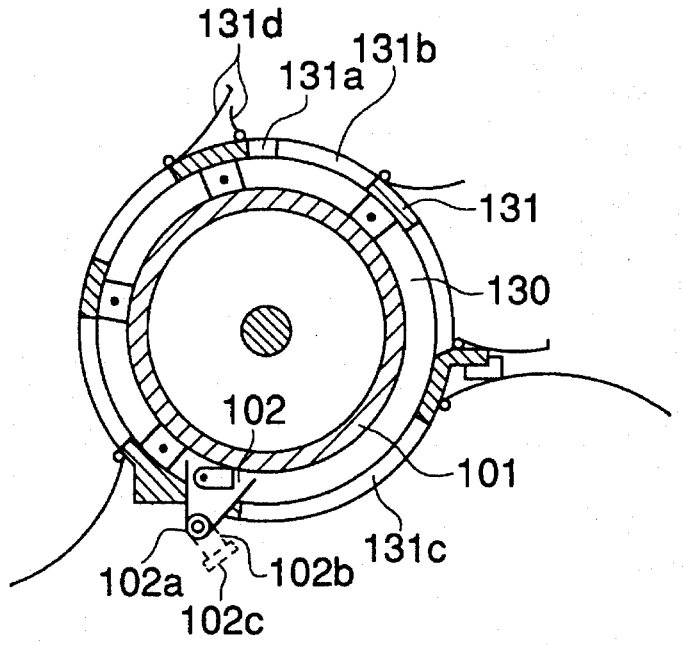
FIG. 26 is a sectional view of the unit frame in the condition that the unit frame is dismounted from the apparatus.
Figure 27:
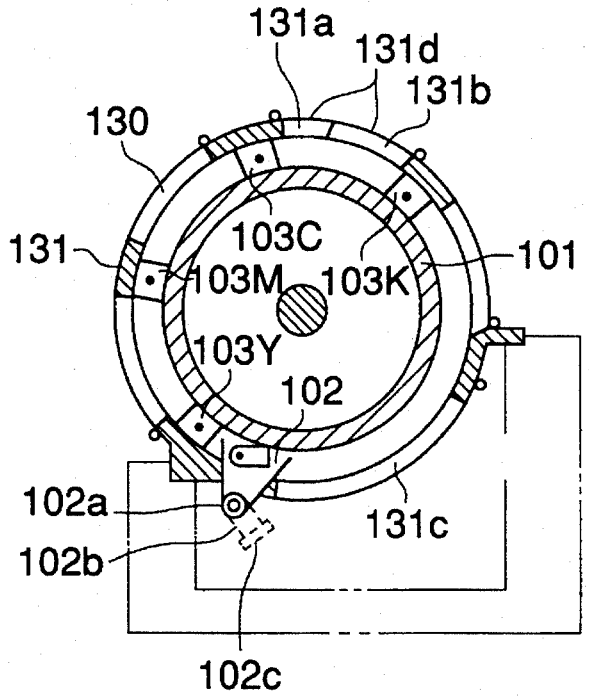
FIG. 27 is a sectional view of the unit frame in the condition that the unit frame is dismounted from the apparatus and the rotatable lid is closed.

FIG. 24 shows the condition that the developing device unit frames 151 are removed from the condition shown in FIG. 23. When the dismounted developing devices 105Y to 105K are mounted again to the position shown in FIG. 23, the mounting can be conducted by the reverse operations of the above operations. In the embodiment that the upper and lower developing devices on the left and right sides of the periphery of the image forming member 101 are moved in parallel, the upper and lower developing devices may be moved individually as shown in the embodiment of FIGS. 14 and 28 without using the developing device unit frame 151.

Figure 29:
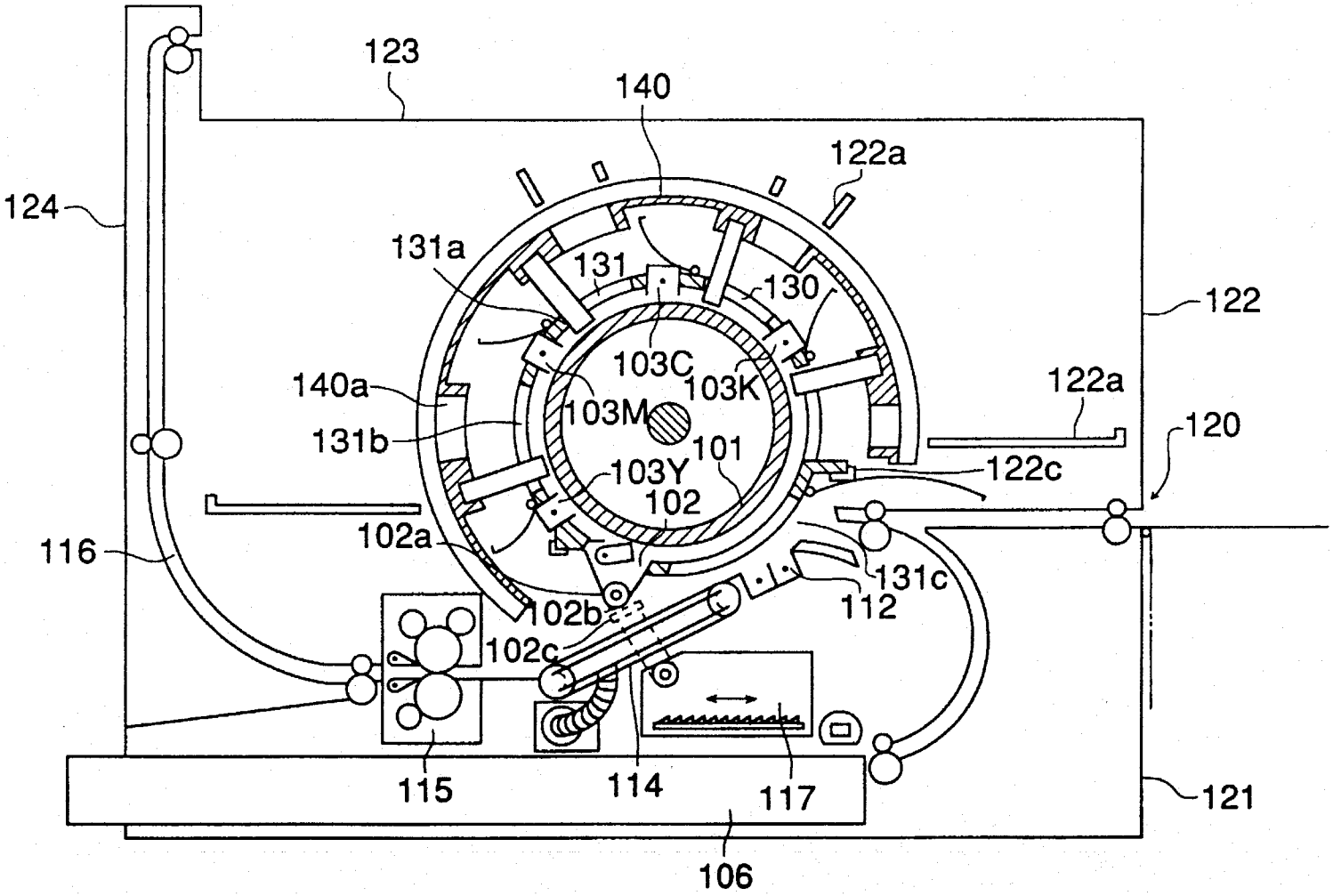
FIG. 29 is a sectional view showing a construction of a color image forming apparatus in the condition that the developing devices are dismounted.
Figure 30:
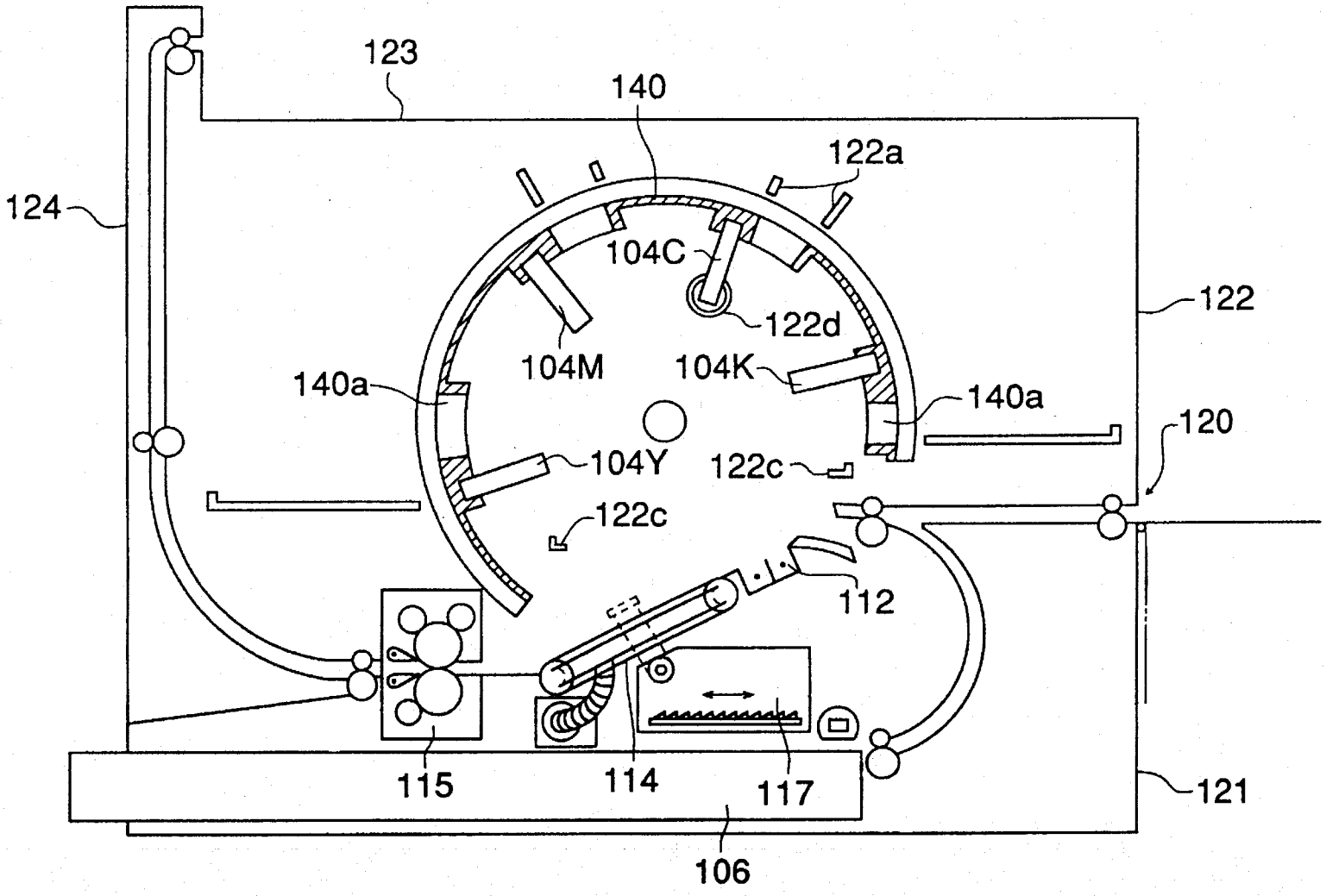
FIG. 30 is a sectional view showing a construction of a color image forming apparatus in the condition that the developing devices and the unit frame are dismounted.
Figure 31:
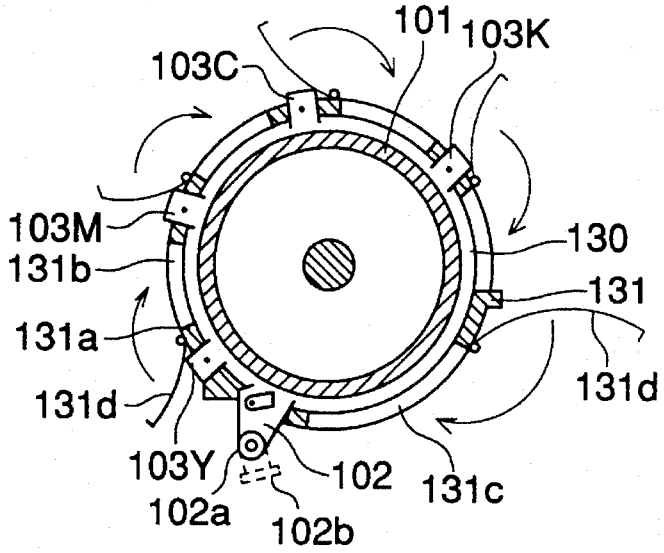
FIG. 31 is a sectional view of the unit frame in the condition that the unit frame is dismounted from the apparatus.
Figure 32:
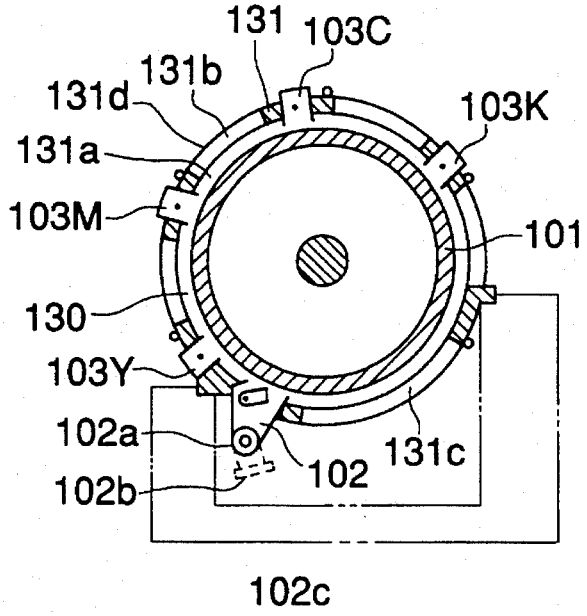
FIG. 32 is a sectional view of the unit frame in the condition that the unit frame is dismounted from the apparatus and the rotatable lid is closed.

The developing devices 105Y to 105K shown in FIGS. 28 and 33 are moved substantially in the radial direction while being guided by the developing device unit frame supporting guide 122*a* provided on the upper frame 122 and the developing device inspection hole 140*a* of the supporting member 140, and take the working position on which the spacer roller of each developing device is brought in pressure contact with the outer circumferential surface of the image forming member or the retracted position on which the developing devices are retracted to the outside of the periphery wall of the fixing member 140. The developing devices 105Y and 105K which are moved in the horizontal direction have the same construction as the developing devices 105Y to 105K in the embodiment of FIG. 14. The developing devices 105M and 105C have a simple drop-fit construction for mounting or dismounting in which the developing devices 105M and 105C slide downward by their own weight so that the spacer roller of each developing device comes in pressure contact with the image forming member 101. In the drop-fit construction, when the pressing force of the spacer roller onto the image forming member 101 is excessively large, if a part of their own weight is borne by a compression spring, the pressing force onto the image forming member 101 can be reduced. FIGS. 29 and 34 shows the condition after the developing devices 105Y to 105K were dismounted from the condition shown in FIGS. 28 and 33.

Figure 22:
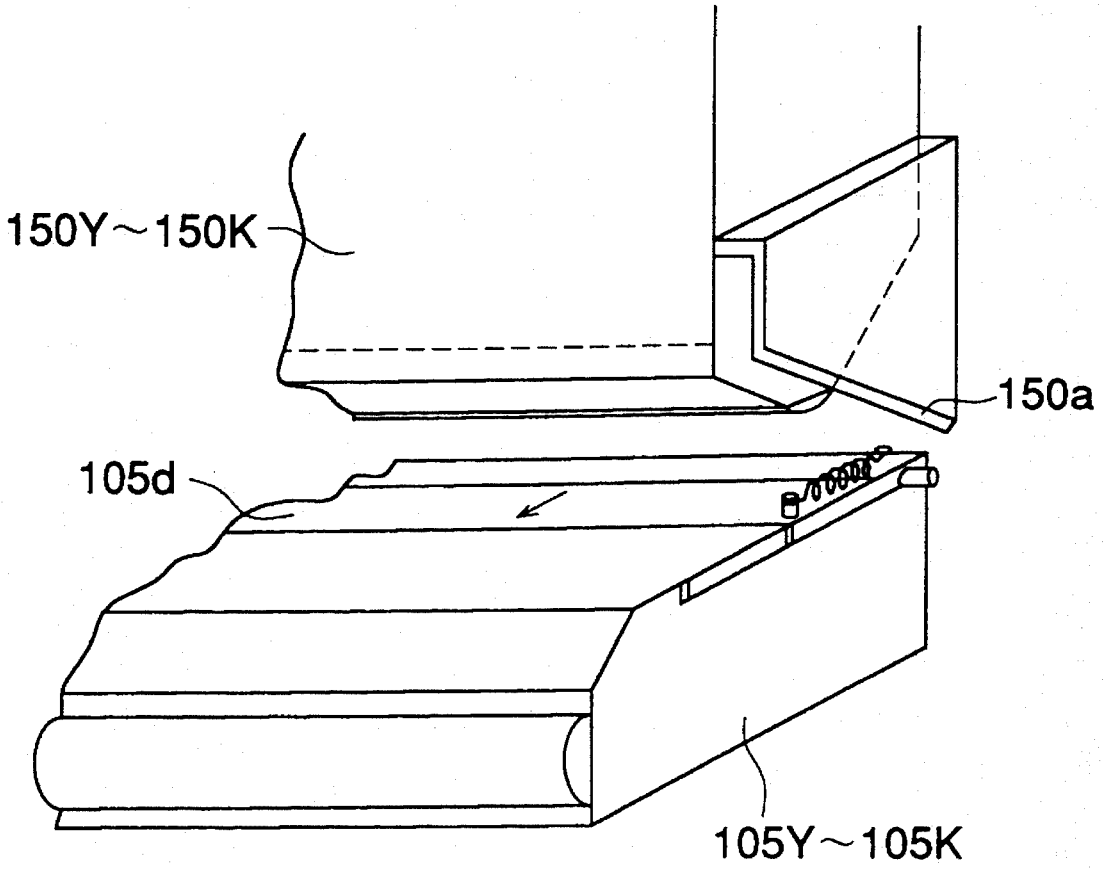
FIG. 22 is a partial perspective view showing a open-close mechanism for a lid provided on the opening of the toner replenishing container connecting section of the developing device.

In the above embodiments, in order to prevent foreign materials from entering into the developing devices 105Y to 105K through an opening at the replenishing container connecting section of the developing devices 105Y to 105K when the toner replenishing containers 150Y to 150K are removed from the developing devices 105Y to 105K, it may be preferable to provide the developing devices 105Y to 105K and the toner replenishing containers 150Y to 150K with a lid open-close mechanism for the opening at the replenishing container connecting section of the developing devices 105Y to 105K as shown in FIG. 22. In the lid open-close mechanism shown in FIG. 22, when the toner replenishing containers 150Y to 150K are dropped along the replenishing container supporting guide provided on the developing devices 105Y to 105K, a driving cam 150*a* provided on the side wall of the toner replenishing containers 150Y to 150K works a driven pin of a sliding lid 105*d* of the developing devices 105Y to 105K and opens the sliding lid 105d by overcoming the spring force, thereby forming an opening for receiving the toner replenishing containers 150Y to 150K. The connection between the developing devices 105Y and 105K are made by inserting the lower section of the toner replenishing containers 150Y to 150K into the opening. When the toner replenishing containers 150Y to 150K are lifted up, the driven pin of the sliding lid 105*b* is released from the actuation of the driving cam 150*a*, and then the sliding lid is returned by the spring force so that the opening is closed.

The toner replenishing containers 150Y to 150K are provided at their lower section with toner feeding roller for dropping toner over the width of the developing device. There is no fear that toner drops unless the toner feeding roller is not rotated. In the above embodiment, the mounting or dismounting operation is conducted by moving the toner replenishing containers 150Y to 150K downward or upward. However, the present invention is not limited to this embodiment. The mounting or dismounting operation may be conducted by the following structure. That is, in the structure that the toner replenishing containers 150Y to 150K are supported by the replenishing container supporting guide provided on the upper frame 122, when the developing devices 105Y to 105K are retracted from the working position, the dismounting may be conducted in such a manner that the connection of a connecting pipe trough which toner is dropped from the replenishing container 150Y to 150K to the developing device 105Y to 105K is disengaged in the retracting direction. Alternatively, the following structure may be also used. That is, toner is fed to the outside of the side wall by a toner feeding screw provided on the lower section of the toner replenishing containers 150Y to 150K, and further is dropped through a toner dropping pipe. The dropped toner is conveyed by another toner feeding screw into the developing devices 105Y to 105K. Incidentally, in the type that the toner feeding screw is used, on the lower section of the toner dropping pipe on the side of the toner replenishing container 150Y to 150K it may be necessary to provide a sliding lid to avoid toner spill-out as being used in the connection between the cleaner 102 and the waste toner container 117.

Figure 15:
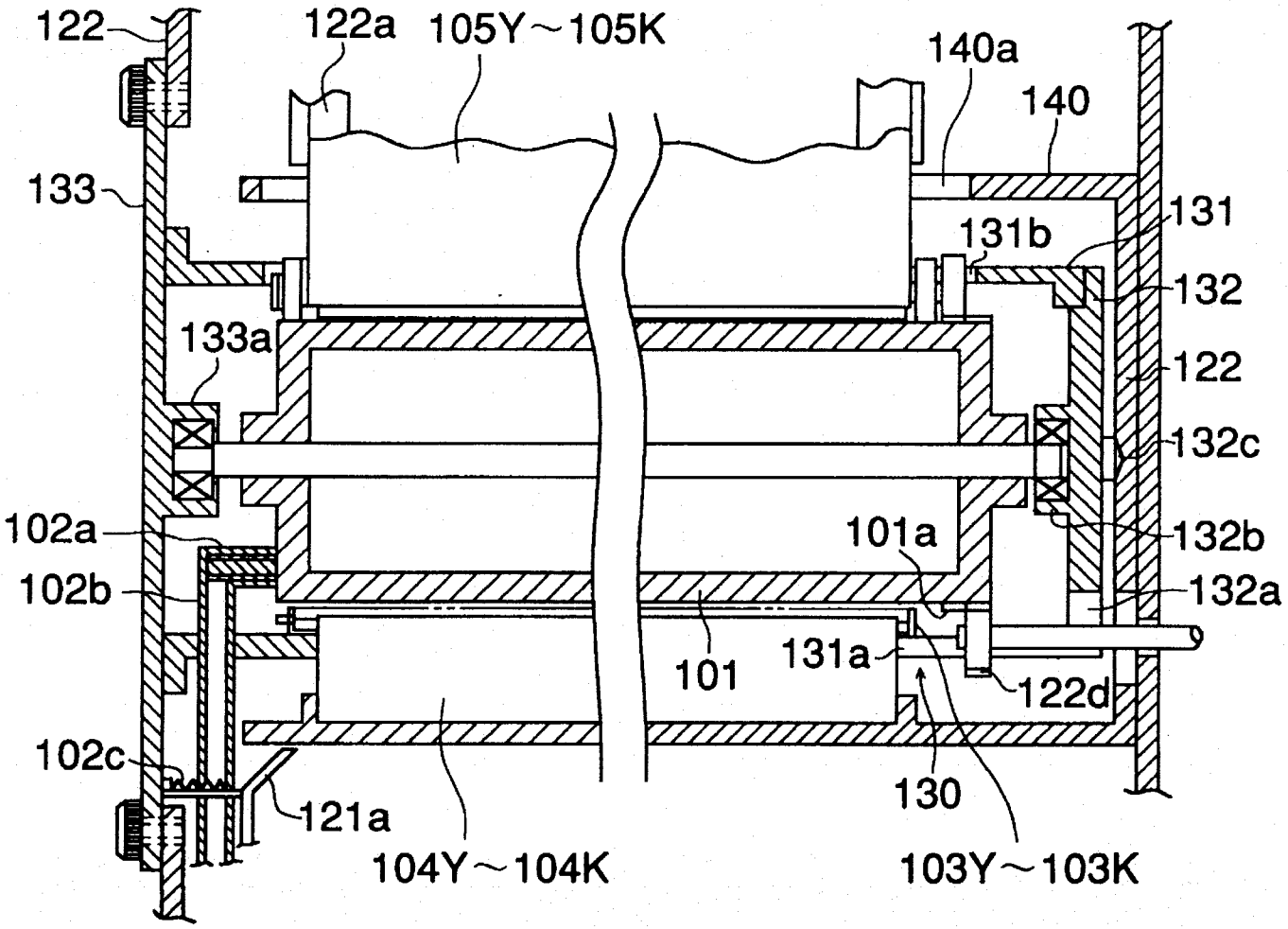
FIG. 15 is a partial sectional view of the apparatus shown in FIG. 14.

The image forming member 101 is incorporated in the unit frame 130 together with a small size lighter charging device 103Y to 103K and the cleaner 102, and is mounted as a single unit on or dismounted from the upper frame 122 as shown in FIG. 15. The cleaner 102 may be structured not to store the toner therein so that the cleaner is smaller and lighter. That is, the unit frame 130 comprises a body 131, a front end plate 132 and an installing member 133. The body 131 has a cylindrical wall surrounding the outer periphery of the image forming member 101, on the cylindrical wall there are provided cut-out grooves 131*a* in which image exposing means 104Y to 104K are inserted or through which image exposure passes, inspection holes 131*b* for developing devices 105Y to 105K and inspection holes 131*c* for a transfer device 112 and a conveyor 114 which are integrally linked. The body 131 supports the cleaner 102 and the charging devices 103Y to 103K. The front end plate 132 has grooves 132*a* on its periphery cut-out through which the image exposure means 104Y to 104K can pass and a bearing retaining section for retaining a bearing of the image forming member 101. The front end plate 132 is fitted to the front end surface of the body 131. The installing member 133 has also a bearing retaining section 133*a* for retaining a bearing of the image forming member 101. The installing member 133 is fitted to the rear end surface of the body 131 and mounted on the outer plate of the upper frame 122. On the condition of the apparatus body 120 shown in FIGS. 18 and 19 or FIGS. 25 and 30 in which the developing devices 105Y to 105K are retracted and the transfer device 112 and the conveyor 114 both integrally linked to each other are rotated clockwise away from the body 131, the unit frame 130 is engaged with the unit frame supporting guide 122*c* provided on the upper frame 122 and is put into the upper frame 122 from the side of the front end plate 132, and the installing member 133 is fixed to the outer plate of the upper frame 122 with set screws, whereby the image forming member 101 is mounted in the upper frame 122 together with the cleaner 102 and the charging devices 103Y to 103K. FIGS. 16, 17, 24 and 29 show this condition. When the image forming device 101 is dismounted together with the unit frame 130, the dismounting can be conducted by the reverse operations of the above operations, whereby the apparatus body 120 is returned to the condition shown in FIGS. 18, 19, 25, and 30.

In order to make it possible to conduct the above mounting and dismounting operations, cut-out grooves 131*a* through which the tip end of the image exposure means 104Y to 104K is inserted or image light from them pass over, setting holes 131*b* through which the developing devices 105Y to 105K are set close to the photoreceptor 101, and setting holes 131*c* through which a unit in which the transfer device 112 and the conveyor 114 are integrally linked is set close to the photoreceptor drum are formed on the periphery wall member 131 of the unit frame 130 which function to support the cleaner 102 and the charging devices 103Y to 103K. A front plate member 132 has at the center on its inside a bearing holding section 132*b* for supporting a bearing of the photoreceptor. Additionally, the front plate member 132 has cut-out grooves 132*b* on its periphery portion corresponding in position to the image exposure means 104Y to 104K, and has at the center on its outside a center protrusion 132*c* which engages with a center hole provided on the center of the front plate section of the supporting member 140 so that the center of the unit frame 130 is conformed to the center of the supporting member 140.

Incidentally, alternatively, a center hole may be formed on the front plate member and a center protrusion may be formed on the supporting member 140.

In the time of mounting or dismounting the unit frame 130, in stead of the construction that the transfer device 112 and the conveyor 114 both integrally linked with each other are rotated clockwise away from the body 131, the upper frame 122 may be rotated for the lower frame 121 until the body 131 of the unit frame 130 is disengaged from the transfer device 112 and the conveyor 114. In this case, to make it possible to retain the rotated open condition of the upper frame 122 is preferable for the purpose of conducting the mounting or dismounting operation safely. Toner is conveyed to the outside of the side wall by the toner conveying screw 102*a* on the lower section and is dropped through a dropping pipe 102*b* into the waste toner container 117 so that the cleaner 102 incorporated in the unit frame 130 is structured not to store the waste toner. However, when the unit frame 130 is dismounted from the upper frame 122, the connection of the dropping pipe 102*b* between the cleaner 102 and the waste toner container 117 may be disengaged. As a result, there may be a fear that toner may spill from the connection of the dropping pipe 102*b*. In order to avoid the toner spill-out, as shown in FIG. 15, a sliding lid 102*c* biased with a spring force in the direction closing the dropping pipe 102*b* is provided on the lower end of the dropping pipe 102*b* and the driving cam 121*a* is provided on the lower frame 121. When the unit frame 130 is mounted in the apparatus body 120 so that the dropping pipe 102*b* is connected, the driving cam 121*a* overcomes the spring force so as to open the sliding lid 102*c*. On the other hand, when the unit frame 130 is drawn out or the upper frame 122 is rotated so as to open so that the connection of the dropping pipe 102*b* is disengaged, the sliding lid 102*c* is released from the actuation of the driving cam 121*a* and closes the dropping pipe 102*b* with the spring force. With this construction, the connection and disconnection of the dropping pipe 102*b* can be conducted without trouble and toner spill-out can be avoided.

Toner is conveyed into the waste toner container 117 by the toner conveying screw and is further conveyed into the inner side by the toner conveying plate which reciprocates with quick return mode in the inside. When the unit frame 130 is mounted as mentioned above, the driving gear 122*d* supported on the upper frame 122 engages with driven gear 101*a* formed on the tip end of the outer periphery of the image forming member 101, whereby the image forming member 101 can be rotated. Further, on the condition that the unit frame 130 has been mounted as shown in FIGS. 16, 17, 24 and 29, the developing devices 105Y to 105K is installed together with the toner replenishing container 150Y to 150K in the upper frame 122, and the transfer device 112 and the conveyor 114 both integrally linked with each other are rotated unticlockwise and set at the predetermined position. Then the apparatus becomes an enable condition for forming an image as shown in FIGS. 14, 15, 23 and 28. Among these drawings, FIG. 15 shows an embodiment in which after the developing devices 105Y to 105K are installed, the driven gear 101*a* of the developing roller engages with the driven gear 101*a* of the image forming member 101 so that rotation force is transmitted from the image forming member 101. However, the developing device may be driven by an independent motor.

Since the cut-out grooves 131*a* through which the image exposure means 104Y to 104K are set or their image light pass over, the inspection holes 131*b* through which the developing devices are mounted, and the inspection hole 131*c* for the unit in which the transfer device 112 and a conveyor 114 are integrally linked are formed on the periphery wall of the body section 131 in the unit frame 130 as mentioned above, there may a problem that the photoreceptor drum 101 may be damaged or may deteriorates because the cut-out grooves 131*a*, the inspection holes 131*b* and 131*c* are exposed on the condition that the unit frame 130 is removed from the upper frame 122. To counter this problem, rotatable lid 131*d* to close the cut-out groove 131*a* and the inspection holes 131*b* and 131*c* are provided on the outer periphery of the body section 131 as shown in FIGS. 14, 16, 20, 23, 24, 26, 28, 29, 31, 33, 34, and 36. When the unit 130 is removed from the upper frame 122, the cut-out groove 131*a* and the inspection holes 131*b* and 131*c* are closed with the rotatable lids 131*d* as shown in FIGS. 21, 27, 32 and 37. Since the unit frame 130 is mounted or dismounted on the condition that the rotatable lids 131*d* are in the opening position, it may be preferable in order to conduct the mounting or dismounting operation for the unit frame 130 safely that the rotatable lids 131*d* are biased with spring force so that the rotatable lids 131*d* take a predetermined opening position when they are moved from the closing position. Further, in order to reduce the number of the rotatable lids 130*d*, it may be preferable that the developing devices 105Y to 105K are moved radially in the mounting or dismounting operation as shown in FIGS. 28 through 32.

Incidentally, in the embodiment shown in FIG. 33, the laser scanner type image exposure means 104Y to 104K may be placed completely on the outside of the unit frame 130 and the slits through which laser beams pass over are provided on the periphery wall member 131. In this case, in order to close the slits when the unit frame 130 is taken out, rotatable lids 131*e* are provided on the internal surface of the periphery wall member 131 and actuation member 104*a* of cam plates to open the rotatable lids 131*e* against the spring bias force are provided on the tip end portion of the image exposure means 104Y to 104K. In order to make the actuation member 104*a* come into the periphery wall member 131 so as to open the rotatable lids 131*e*, cut-out grooves 131*a* may be used in place of the slits. Accordingly, cut-out grooves 132*a* to allow the actuation member 104*a* to pass through are also provided on a periphery portion of the front plate 132.

In the color forming apparatus of the present invention, since a color image is formed during a single rotation of the drum-shaped image forming member, a color image formation is faster. Further, since the plural image exposure means are mounted radially on the cylindrical supporting member enclosing the image forming member, the incident position of image light from each image exposure means onto the image forming member can be easily set at a predetermined position and high quality color image can be formed on the image forming member without color deviation. Further, as the image exposure means for forming dot images, in the case of using a laser scanner, the body section of the supporting member on which the exposure means are mounted is shaped in the form of a cylinder, thereby refraining the occurrence of the vibration and the positional deviation of the image exposure and forming more clear color image. The one end of the supporting member on which the image exposure means are mounted is fixed to the apparatus body and the other end of the body section is opened so at to receive the image forming member therein. The image forming member is rotatably supported in the unit frame. The unit frame has a periphery wall enclosing the outer periphery of the image forming member. On the periphery wall are provided cut-out grooves or holes through which the image exposure means or the image light pass over. The unit frame is moved in the axial direction of the image forming member through the opening end of the supporting member on the condition that the plural developing devices are dismounted outside the unit frame so that the unit frame is mounted on or dismounted from the apparatus body. With this construction, the assembling work, the maintenance work, and the replacing work for the image forming member and image forming means associated with the image forming member and the toner replenishing work for the developing deviced can be conducted easily. As a result, the developing device can be made smaller, the image forming member and the periphery of the image forming member can be made compact, and the apparatus can be made relatively small and manufacture at low cost.

An embodiment regarding the charging device and the cleaning device will be explained hereinafter.

Figure 39:
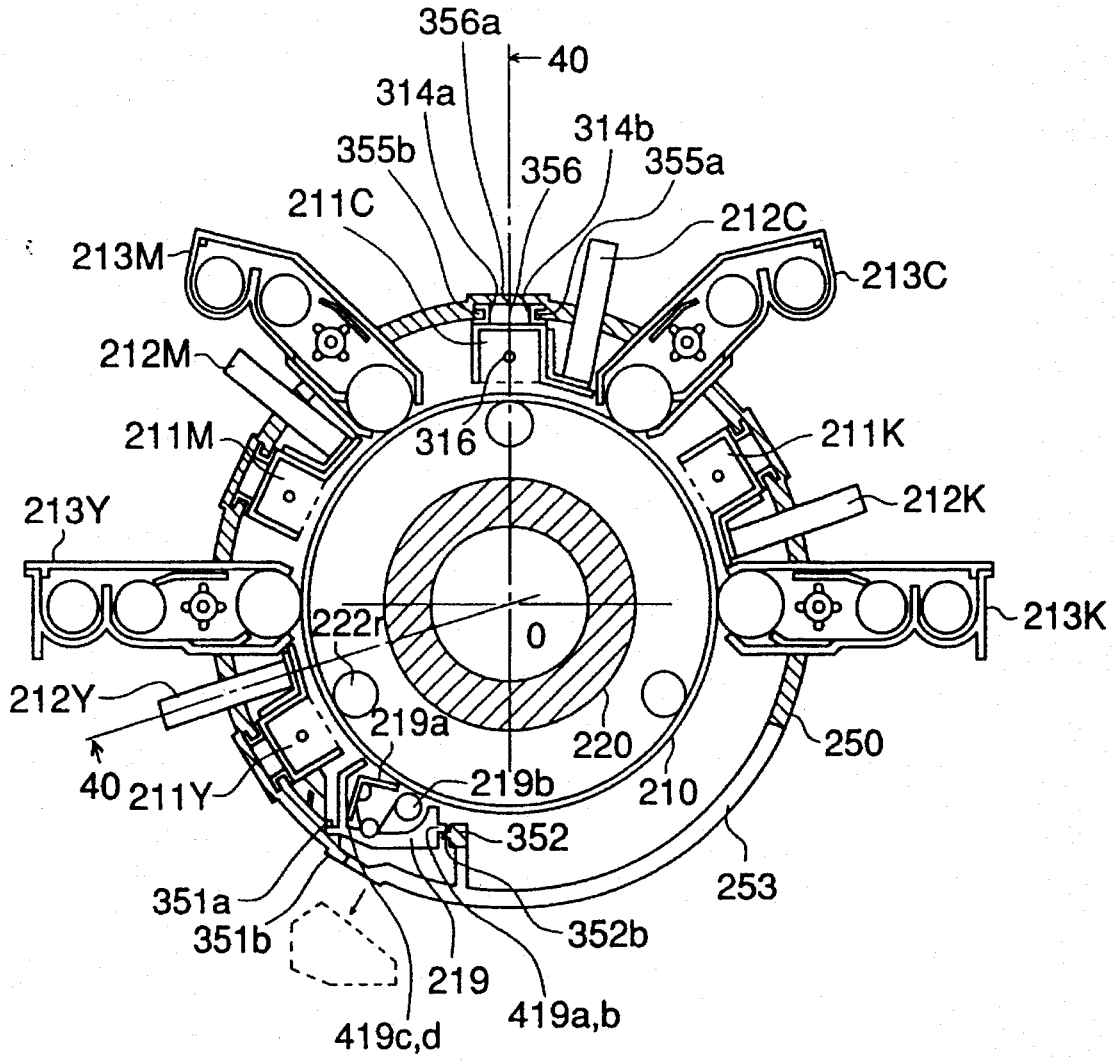
FIG. 39 is a sectional view of the principle part of the apparatus shown in FIG. 38.
Figure 40:
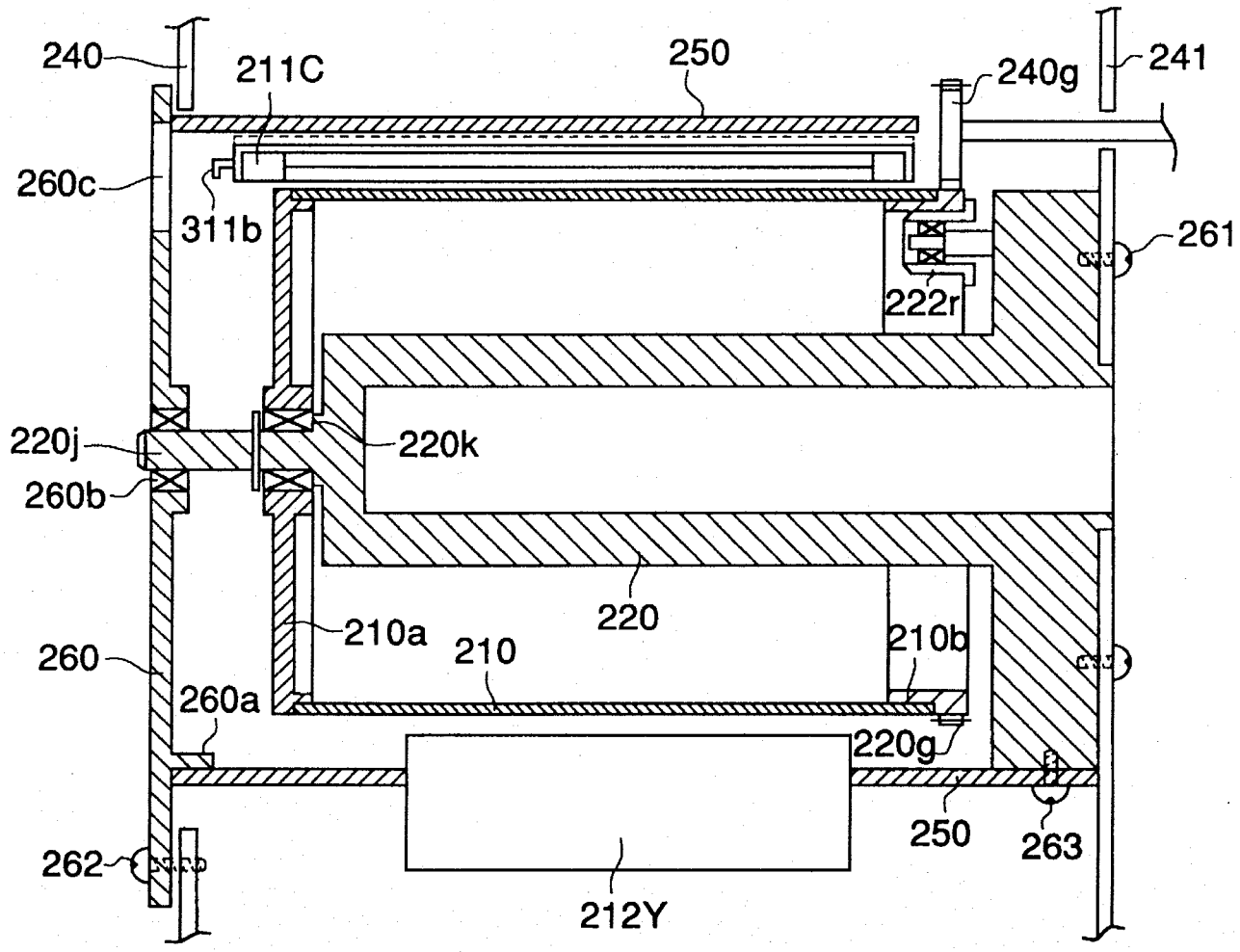
FIG. 40 is a sectional view of the section A—O—A in FIG. 39.
Figure 41:
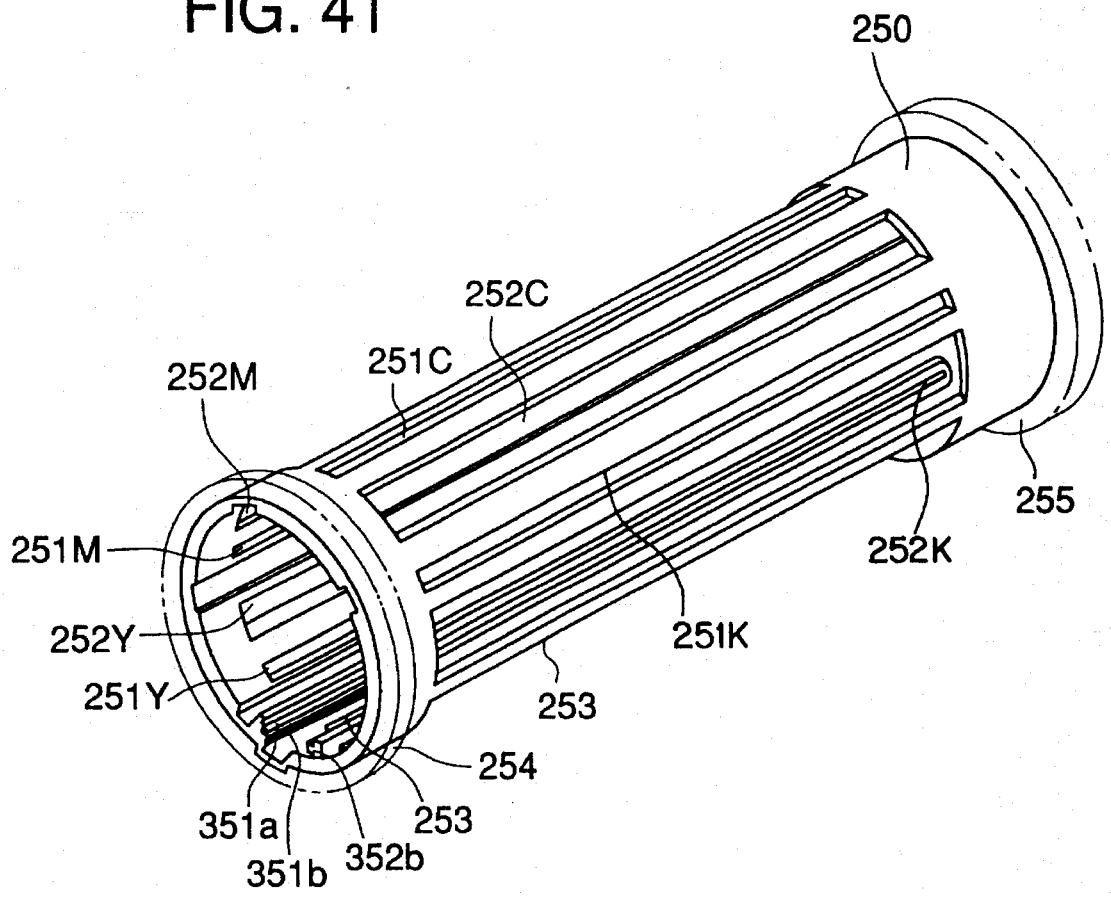
FIG. 41 is a perspective view of the support member.

Another structure of the color image forming apparatus will be explained with reference to FIGS. 39–41. FIG. 39 is a sectional view showing a principal part of FIG. 38. FIG. 40 is a sectional view on the A—O—A section in FIG. 39. FIG. 41 is an outline view of the supporting member.

A circle pillar-shaped drum supporting shaft 220 is provided with three pieces of guide rollers 222*r*, and fixed on a side plate 241 on the rear portion of the apparatus with screws 261 on the condition that the three pieces of guide rollers 222*r* are mounted thereon. The photoreceptor drum 210 which is integrated with a front flange 210*a* and a rear flange 210*b* provided 220*j* respectively on its both ends is inserted into a shaft provided on the drum supporting shaft from the front side (the left side in FIG. 40) of the apparatus body, and is supported rotatably by a bearing 220*k* provided on the flange 210*a* and by the three pieces of guide rollers 222*r*. At this time, a photoreceptor drum gear 220*g* provided on the rear flange 210*b* is engaged with a driving gear 240*g* so that the photoreceptor is placed on the condition that the photoreceptor is rotated through the driving gear 240*g* by the driving of the photoreceptor driving motor provided on the apparatus body.

A cylindrical supporting member 250 is provided coaxially with the cylindrical photoreceptor drum 210 on the outside of the photoreceptor drum 210 so as to confine the photoreceptor drum 210. Scorotron charging devices 211Y, 211M, 211 C and 211K are mounted on the cylindrical supporting member 250. Also, the optical exposure systems 212Y, 212M, 212C and 212K are inserted and mounted in attaching holes 251Y, 251M, 251C and 251K provided on the supporting member 250 and the cleaning device 219 is inserted and mounted in the guide rails 351*b* and 352*b*. The scorotron charging devices 211Y, 211M, 211C and 211K and the cleaning device 219 are detachably mounted on the supporting member 250 as described later.

In order to conform the positions of the drum supporting shaft 220 and the supporting member relatively with each other, the supporting member 250 on which the scorotron charging devices 211Y, 211M, 211 C and 211K, the optical exposure systems 212Y, 212M, 212C and 212K and the cleaning device 219 are mounted is inserted on the end portion of the drum supporting shaft 220 and fixed on the drum supporting shaft 220 with screws 263 on the condition that the supporting axis of the photoreceptor 210, that is, the center of the cylindrical photoreceptor 210, the center of the drum supporting shaft 220 and the center of the cylinder section of the cylindrical supporting member 250 agree among each others. Developing devices 213Y, 213M, 213C and 213K are fixed to mounting holes 252Y, 252M, 252C and 252K provided on the supporting member 250 on the condition that the developing devices are kept non-contacted with the photoreceptor drum 210. Further, a transfer device **214*a*, a charge-eliminating device 214*b*, and a conveying belt 214*e* are arranged in a cut-out opening 253 and are fixed on the non-contact condition with the photoreceptor drum 210. A holding member 260 equipped with a bearing 260*b* is fixed with screws 262 to a side plate 240 on a front side of the apparatus body on the condition that the bearing 260*b* is inserted into the supporting shaft 220, a fitting section 260*a* is adjusted its position with respect to the cylindrical supporting member 250 and is fitted with it, and the axis of the photoreceptor drum 210** is supported.

Since the cylindrical supporting member is coaxially provided with respect to the photoreceptor drum 210, the photoreceptor drum 210 and the supporting member 250 expand radically while keeping the positional relation between them around the axis of the photoreceptor drum for the change in the inside and outside temperature of the apparatus so that the positions of the scorotron charging devices 211Y, 211M, 211C and 211K, the optical exposure systems 212Y, 212M, 212C and 212K and the cleaning device 219 are kept precisely in relation to the photoreceptor drum 210 without causing a change in their angle positions and the distance in relation to the photoreceptor drum 210. In particular, the registration of the optical exposure systems are kept precisely, whereby toner images are superimposed precisely and a good color image is formed. In order to maintain the registration of the optical exposure systems, it may be better for the supporting member 250 to be not provided with the cut-out portion, and it may be preferable that the mounting holes and cut-out opening provided on the supporting member 250 are smaller. Further, as shown in FIG. 41 with two doted lines, it may be preferable to provide collar portions 254 and 255 on both side sections of the supporting members 250.

In the time of inspection or maintenance for the apparatus body, the scorotron charging devices 211Y, 211M, 211C and 211K and the cleaning device 219 can be mounted on or dismounted from holes **260*c* provided on the holding member 260. Further, on the condition that the screws 262 is removed and the holding member 260 is detached from the support shaft 220*j*, it become possible to mount, dismount or replace the scorotron charging devices 211Y, 211M, 211C and 211K, the cleaning device 219 and the photoreceptor drum 210**.

Figure 42:
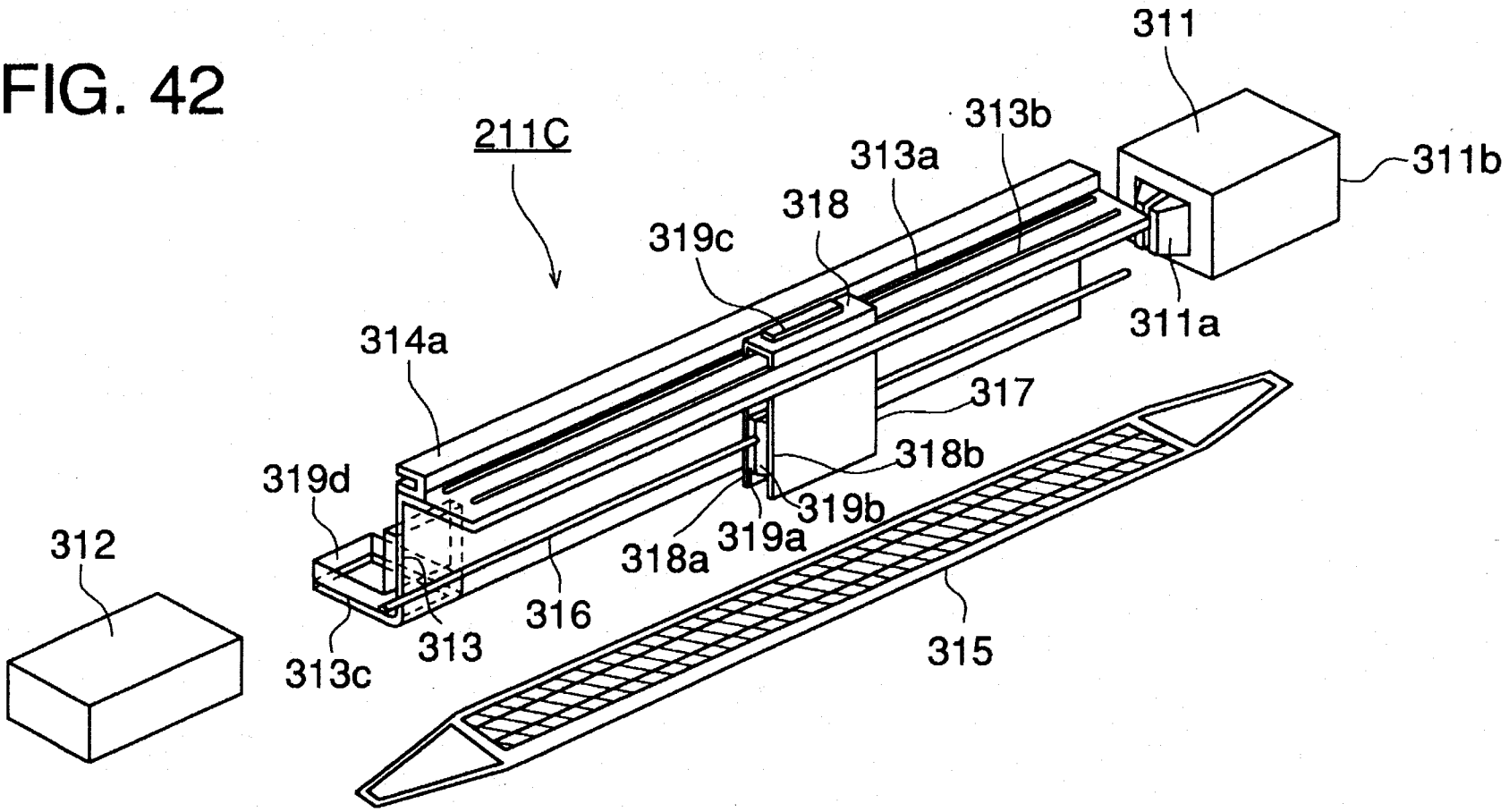
FIG. 42 is a perspective view of the scorotron charging device.

The structure of scorotron charging devices 211Y, 211M, 211C and 211K and an operation for mounting or dismounting them will be explained with reference to FIGS. 39, 40 and 42. FIG. 42 is a sectional view showing a structure of the scorotron charging devices. The explanation will be made for the scorotron charging devices 211C as the representative of other scorotron charging devices, because the scorotron charging devices 211Y, 211M, and 211K have the same structure as the scorotron charging devices 211C.

The scorotron charging device is constructed in such a way that a corona discharging wire 316 is extended between electrode holding members provided on left and right sides, and side plates 313 as sealing members and a control grid 315 are mounted in parallel to the corona discharging wire 316. On the top surface of the letter U-shaped side plate 313, there are provided two lines of grooves **313*a* and 313*b* in parallel. A cleaning means 317 for cleaning the corona discharging wire is attached to the grooves 313*a* and 313*b*. Guide rails 314*a* and 314*b* used to mount or dismount the scorotron charging device are provided on both sides of the grooves 313*a* and 313*b*. A cleaning pad mounting section 313*c* is provided on one side of the side plate 313 which is the left side in FIG. 42 and locates on the rear side on the condition that the scorotron charging device 211C is mounted in the image forming apparatus. A letter "L"-shaped cleaning pad 319*d* for cleaning the optical exposure system is mounted on the cleaning pad mounting section 313*c***.

A frame 318 of the cleaning means 317 for the corona discharging wire has on its left and right sides two pieces of legs **318*a* and 318*b* having the spring property. The legs 318*a* and 318*b* are inserted into the two lines of the grooves 313*a* and 313*b* on the side plate 313 respectively. Cleaning members 319*a* and 319*b* are provided insides of the legs 318*a* and 318*b* so as to sandwich the corona discharging wire 316. The legs 318*a* and 318*b* of the cleaning means 317 are slidable along the grooves 313*a* and 313*b* so that the corona discharging wire 316 is cleaned with the cleaning members 319*a* and 319*b***.

As shown in FIG. 39, an insertion opening 356 of the supporting member 250 is provided with guide grooves **355*a* and 355*b* with which the guide rails 314*a* and 314*b* are engaged so that the scorotron charging device 211C is inserted into the insertion opening 356. A friction member 319C is provided on the top of the frame 318 of the cleaning means 317. When the scorotron charging device 211C is inserted into the insertion opening 356, the friction member 319C is brought in contact with an upper portion 356*a* of the insertion opening 356 provided on the inserting side of the image forming apparatus so that the cleaning means is stopped at the inserting side. The corona discharging wire 316 is cleaned by the cleaning members 319*a* and 319*b* which sandwich the corona discharging wire 316 between them with pressure as the scorotron charging device 211C is inserted into the insertion opening 356. When the insertion is completed, protruding members 311*a* provided on the electrode holding member 311 at the right side in FIG. 42 push the legs 318*a* and 318*b* of the frame 318 so that the cleaning means 317 is fixed on the inserting side of the insertion opening 356 of the image forming apparatus in the condition that the friction member 319C is kept contacting with an upper portion 356*a* of the insertion opening 356. In this time, the legs 318*a* and 318*b* having spring property are expanded by the taper portion of the protruding members 311*a*, whereby the corona discharging wire is released from being sandwiched with pressure between the cleaning members 319*a* and 319*b***.

When the scorotron charging device 211C is dismounted by being pulled with a handle **311*b* provided thereon through an opening 260C on the holding member 260 shown in FIG. 40, the abovementioned friction member 319C is kept contacting with the upper portion 356***a* of the insertion opening 356 by the friction force. Accordingly, the corona discharging wire 316 is sandwiched again with pressure between the cleaning member 319*a* and 319*b*, whereby the corona discharging wire 316 is cleaned by the cleaning member 319*a* and 319*b* as the scorotron charging device 211C is pulled out from the insertion opening 356. When the scorotron charging device 211C is further pulled after the rear side electrode holding member 312 came in contact with the frame 318 of the cleaning means 317, the friction member 319C is released from the friction force and detached from the upper portion 356*a* of the insertion opening 356. Finally, the scorotron charging device 211C is dismounted on the condition that the cleaning means 317 is incorporated in the scorotron charging device 211C.

As mentioned above, cleaning maintenance for the corona discharging wire is conducted when the scorotron charging device is mounted or dismounted. Simultaneously, the cleaning pad 319*d* provided on the scorotron charging device 211C slidingly contact with the exposure section of the optical exposure system 212C so that the cleaning pad 319*d* cleans the optical exposure system 212C which locates in the vicinity of the developing device and is apt to be soiled with toner.

Figure 43:
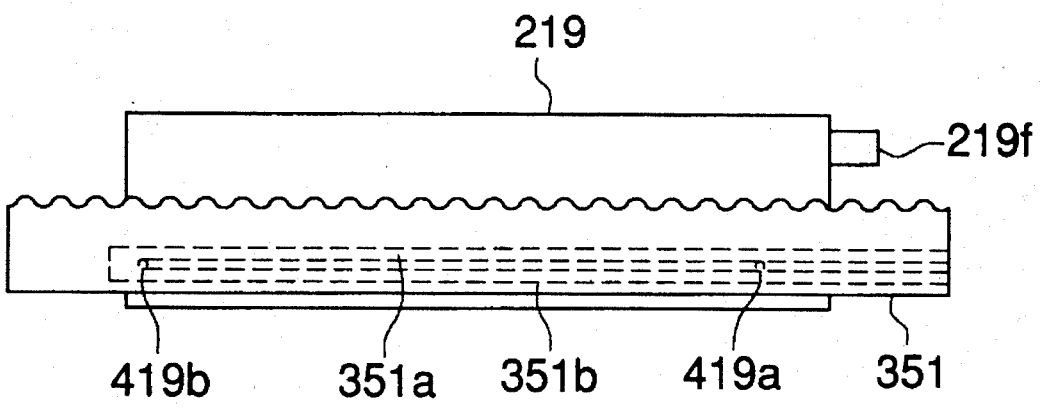
FIG. 43 is a sectional view of the mounting and dismounting section for the cleaning device.

Next, a mounting and dismounting operation conducted in the time of replacement or maintenance for cleaning apparatus and a photoreceptor drum will be explained with reference to FIGS. 39 through 41 and 43. FIG. 43 is a side view of a mounting and dismounting section of the cleaning apparatus 219.

Guide pins 419*a*, 419*b*, 419*c* and 419*d* are provided on left and right sides of the cleaning apparatus 219. Left and right guide member 351 and 352 for inserting the cleaning apparatus 219 are integrally provided on the supporting member 250. The guide pins 419*a* and 419*b* are inserted into upper and lower guide rails 351*a* and 351*b* on the left guide member 351, and the guide pins 419*c* and 419*d* are inserted into the upper and lower guide rails 352*a* and 352*b* on the right guide member 352 so that the cleaning apparatus 219 is mounted as shown in FIG. 43. The cleaning apparatus 219 can be mounted on or dismounted from the supporting member 250 by pushing or pulling a handle 219*f*. Alternately, as shown in FIG. 39, the cleaning devices 219 may be detached from the supporting member 250 in the arrowed direction through a cut-out opening 253 on the supporting member 250 along an illustrated guide rail to a outer periphery of the cylindrical supporting member 250. It may be possible to conduct replacement or maintenance for the cleaning device 219 by further pulling out the cleaning device 219 from the outer periphery.

Figure 38:
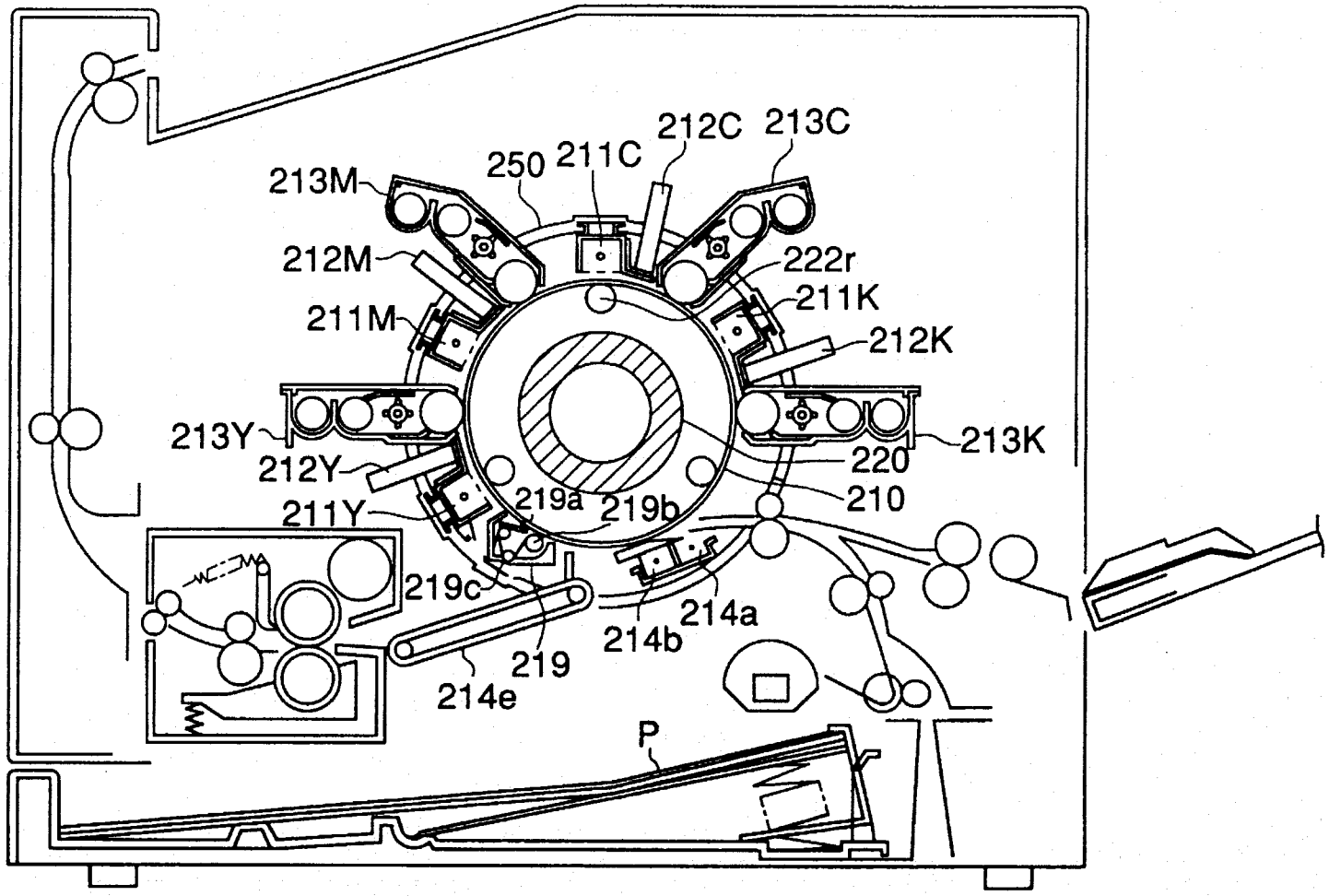
FIG. 38 is a sectional view showing a construction of a color image forming apparatus of another embodiment of the present invention.

In the image forming process explained in FIG. 38, since the cleaning blade 219*a* and cleaning roller 219*b* provided in the cleaning device 219 are spaced from the photoreceptor drum 210 in order to avoid the damage on the photoreceptor drum after the image formation is completed, when the maintenance work or the replacement is conducted for the photoreceptor, it may be possible to conduct the maintenance or the replacement on the condition that the photoreceptor drum 210 is drawn out after the holding member 260 is removed shown in FIG. 40.

In the case that the image forming process is conducted while the cleaning blade 219*a* and the cleaning roller 219*b* are kept contacted with the photoreceptor drum 210, after the cleaning device 219 is moved away from the photoreceptor drum 210 in the radial direction shown with an arrow mark in FIG. 39, the photoreceptor drum can be drawn out in parallel to the drum supporting shaft 220.

Next, as another embodiment regarding the mounting for the cleaning device, the construction in which the cleaning device can be mounted or dismounted as one unit together with the photoreceptor drum without moving the cleaning device from the photoreceptor drum will be explained hereinafter.

Figure 44:
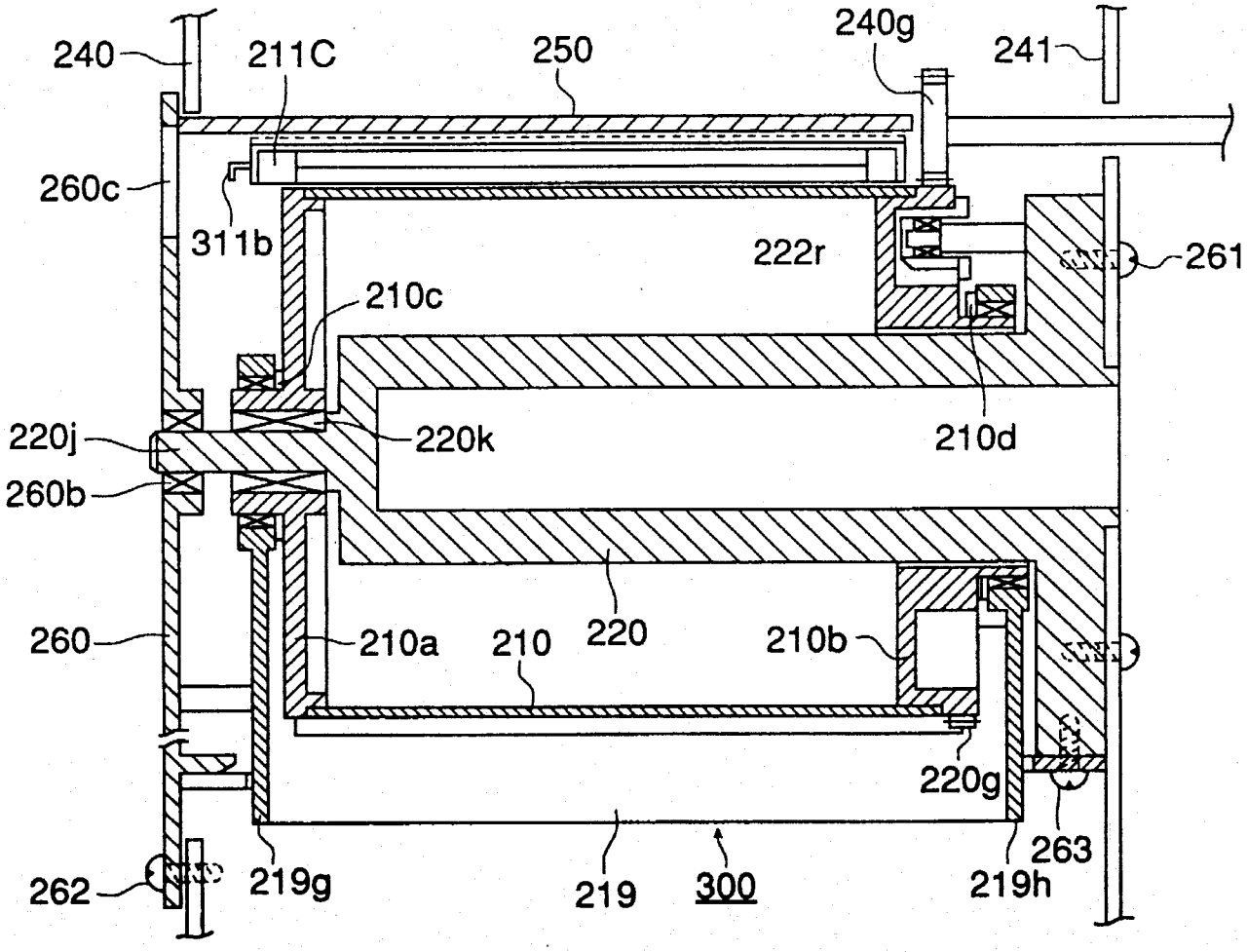
FIG. 44 is a partial sectional view of a color image forming apparatus of another embodiment of the present invention.

In FIG. 44, a front flange 210*a* and a rear flange 210*b* are provided on the both ends of the photoreceptor drum 210. Cleaner side plates 219*g*, 219*h* are fitted on the outside of each of the front and rear flanges 210*a*, 210*b* and spacers 210*c*, 210*d* are provided between the cleaner side plates 219*g*, 219*h* and the front and rear flanges 210*a*, 210*b*. The cleaning device 210 is sandwiched between the cleaner side plates 219*g*, 219*h* and fixed with screws. As a result, the cleaning device is constructed integrally in one unit with the photoreceptor drum 210.

Figure 45:
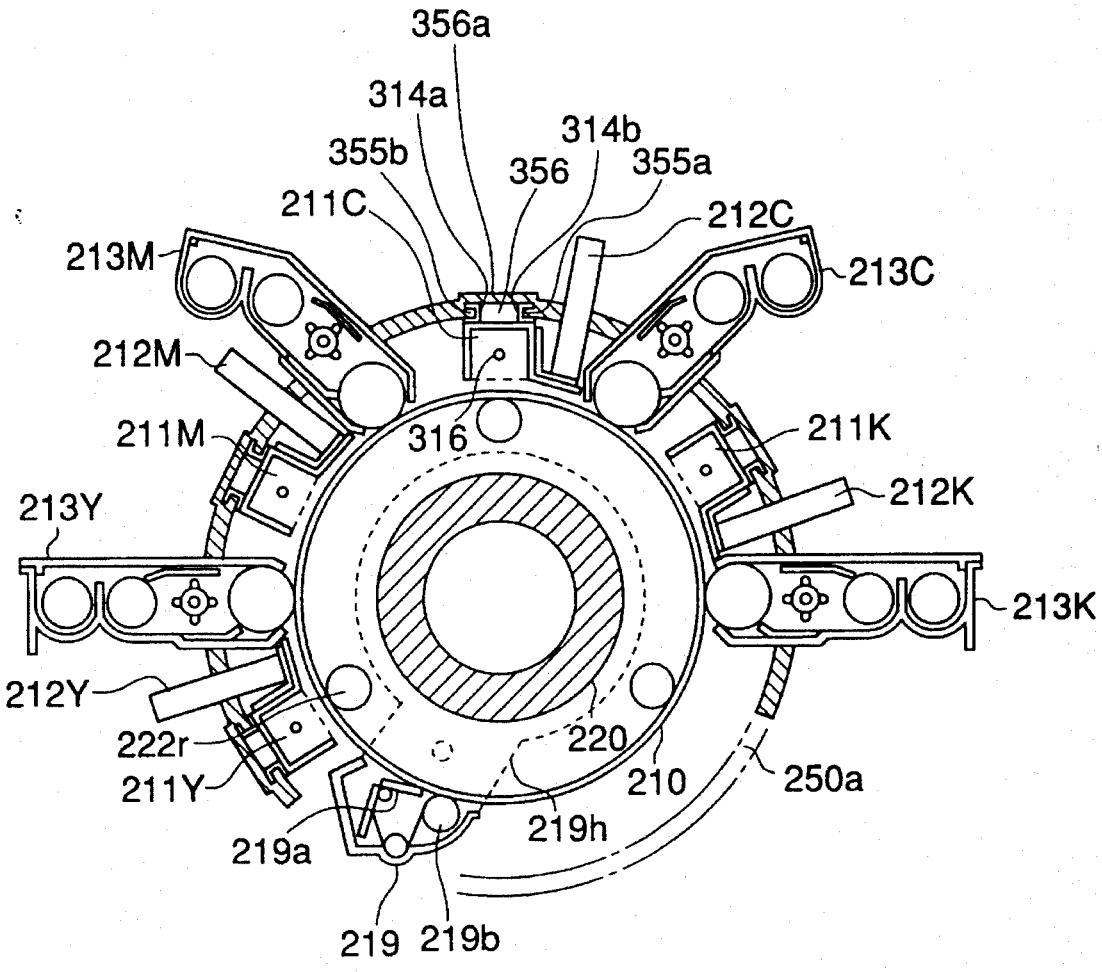
FIG. 45 is a sectional view of the apparatus shown in FIG. 44.

As shown in FIG. 45, on the condition that the holding member 260 is removed, the unit 300 in which the photoreceptor drum 210 and the cleaning device 219 are integrally incorporated can be mounted on or dismounted from the color forming apparatus body. In the mounting or dismounting, the cleaning device 219 on the unit 300 passes through the cut-out section 250*a* of the supporting member 250.

In this embodiment, since the cleaning device 219 and the photoreceptor drum 210 are constructed integrally in one unit, when the maintenance work is conducted for the photoreceptor drum 210 or the cleaning device 219, toner scattering from the cleaning device 219 can be avoided.

Incidentally, each of the supporting member and the unit 300 can be mounted on the drum supporting shaft 220 earlier than each other. In order to maintain the registration of the optical exposure systems, it may be preferable to mount the supporting member 250 earlier than the unit 300. In this case, it may be preferable to shape the cylinder section of the supporting member 250 positioned at the rear side of the apparatus body in a ring without a cut-out section as shown in FIG. 41, further, it may be preferable to provide ear-shaped section indicted with two dot chain lines on both ends of the supporting member in order to avoid deformation.

With above embodiments, since the cylindrical supporting member is provided coaxially around the photoreceptor drum, the photoreceptor drum and the supporting member are expanded radially around the axis of the photoreceptor drum for change in environmental temperature or apparatus inside temperature while maintaining positional relation between them around the axis of the photoreceptor, whereby the angle position and the distance from the photoreceptor drum of each of the scorotron charging devices, the optical exposure systems, and the cleaning device mounted on the supporting member are not changed, the positional precision is maintained, the color image formation with the superior toner image superimposition is conducted, and, especially, high precise registration of the optical exposure systems is maintained.

The photoreceptor drum or the other machinery components can be replaced independently while keeping the high precise positional relation.

The corona discharging wire of the scorotron charging device which is positioned closer to the developing device and is apt to be soiled may be cleaned easily.

The optical exposure system which is positioned closer to the developing device and is apt to be soiled may be cleaned easily.

With above embodiments, in the structure that the cylindrical supporting member provided coaxially with the photoreceptor drum is partially cut out, since the photoreceptor drum and the cleaning device are constructed integrally in a single unit, toner scattering from the cleaning device can be avoided when the maintenance work is conducted for the photoreceptor or the cleaning device.

If the transfer sheet is stopped in the vicinity of the transfer section due to some trouble, a wide space can be formed by moving the transfer device away from the photreceptor, thereby conducting the removing operation easily. Further, since the transfer device can be mounted on the apparatus body side, the mounting or dismounting operation can be conducted easily by moving the transfer device away from the photoreceptor drum.

What is claimed is:

1. An apparatus for forming a color image, comprising:

a cylindrical photoreceptor;

a plurality of charging devices each for electrically charging the photoreceptor for one of plural different colors;

a plurality of image exposure devices each for imagewise exposing the charged photoreceptor so as to form a latent image;

a plurality of developing devices, each developing device developing the latent image so as to form a toner image in a color different from others;

the plurality of charging devices, the plurality of image exposure devices, and the plurality of developing devices being arranged around the outer circumference of the photoreceptor so that a color image is formed during a single rotation of the photoreceptor; and a supporting member for supporting the plurality of image exposure devices substantially on a circle which is coaxial with an axis of the photoreceptor.

2. The apparatus of claim 1, wherein the plurality of image exposure devices are radially arranged on the supporting member.

3. The apparatus of claim 1, wherein the plurality of image exposure devices are arranged around the supporting member in such a manner that the plurality of image exposure devices are spaced from each other with an equal distance between adjacent image exposure devices.

4. The apparatus of claim 1, wherein an image light emitted from each of the plurality of image exposure devices is directed toward the center of the photoreceptor.

5. The apparatus of claim 4, wherein an angle formed between neighboring image lights is equal to that formed by another image lights.

6. The apparatus of claim 1, wherein image lights emitted from some of the plurality of image exposure devices are not directed toward a center of the photoreceptor.

7. The apparatus of claim 6, wherein a light emitting direction of the image lights is arranged so that the corresponding image exposure device is placed in parallel to a neighboring image exposure device.

8. The apparatus of claim 6, wherein an incident angle of the image light on the photoreceptor is 0° to 45°.

9. The apparatus of claim 6, wherein an incident angle of the image light for black on the photoreceptor is 0° to 20°.

10. The apparatus of claim 1, wherein the plurality of image exposure devices are mounted on an inside wall of the supporting member.

11. The apparatus of claim 1, wherein the supporting member comprises a plurality of grooves in the axial direction thereof, and each of the plurality of image exposure devices is fixed in a groove.

12. The apparatus of claim 1, wherein each of the plurality of image exposure devices comprises an LED array in which LED elements are aligned in the axial direction of the photoreceptor.

13. The apparatus of claim 12, wherein the supporting member is partially cut out in the axial direction.

14. The apparatus of claim 1, wherein the plurality of image exposure devices comprise plural laser scanners, and wherein the plural laser scanner are mounted radially around the supporting member.

15. The apparatus of claim 1, further comprising:

a transfer device for transferring the color toner image onto a sheet; and a cleaning device for cleaning the photoreceptor after the color toner image is transferred.

16. The apparatus of claim 15, wherein at least one of the cleaning device and the plurality of charging devices is supported by the supporting member.

17. The apparatus of claim 16, wherein at least one of the cleaning device and the plurality of charging devices is replaceable with a spare one.

18. The apparatus of claim 16, wherein at least one of the cleaning device and the plurality of charging devices is replaceable with a spare one together with the photoreceptor.

19. The apparatus of claim 15, wherein:

the supporting member comprises a cylindrical member; and at least one of the cleaning device and the plurality of charging devices is mounted on an inside wall of the cylindrical member.

20. The apparatus of claim 15, wherein:

the photoreceptor is supported in a cartridge; and at least one of the cleaning device and the plurality of charging devices is supported by the cartridge.

21. The apparatus of claim 20, wherein at least one of the cleaning device and the plurality of charging devices is replaceable with a spare one.

22. The apparatus of claim 15, wherein the supporting cylinder has setting holes through which the plurality of developing devices are inserted respectively to working positions on which the plurality of developing devices develop the latent images or retracted from the working position to a rest position.

23. The apparatus of claim 22, wherein the supporting member has one end which is fixed to the apparatus, and another end which is kept opened so that the photoreceptor is mounted inside the supporting member through an open end of the supporting member.

24. The apparatus of claim 23, wherein the photoreceptor is mounted on or dismounted from the supporting member when the plurality of developing devices are retracted to the rest position.

25. The apparatus of claim 24, further comprising a unit frame in which the photoreceptor is rotatably supported, and wherein the unit frame is mounted on or dismounted from the supporting member together with the photoreceptor.

26. The apparatus of claim 25, wherein the unit frame has a cylindrical frame on which there are provided:

exposure holes through which the plurality of image exposure devices are inserted or image lights pass over; and setting holes through which the plurality of developing devices are inserted respectively to the working positions.

27. The apparatus of claim 26, wherein the unit frame has lids to close or open the exposure holes and the setting holes.

28. The apparatus of claim 26, wherein the unit frame is mounted on or dismounted from the supporting member when the plurality of developing devices are retracted to the rest position.

29. The apparatus of claim 26, wherein at least one of the cleaning device and the plurality of charging devices is supported by the cylindrical frame.

30. The apparatus of claim 29, wherein the photoreceptor and the cleaning device are integrally constructed in a unit capable of being mounted on or dismounted from the supporting cylinder, and wherein the cleaning device on the unit is arranged at a position corresponding to the cut-out section on the supporting member.

31. The apparatus of claim 29, wherein the transfer device is arranged at a position corresponding to the cut-out section on the supporting member.

32. The apparatus of claim 15, wherein the supporting member is partially cut out in the axial direction so as to form a cut-out section.

33. The apparatus of claim 15, wherein the plurality of charging devices are mounted on the supporting member.

34. The apparatus of claim 33, wherein each of the charging devices comprises an electrode and a cleaning member, and the electrode and the charging devices are arranged in such a manner that when each charging device is mounted on or dismounted from the supporting member, the cleaning member cleans the electrode.

35. The apparatus of claim 33, wherein each of the charging devices comprises a cleaning member to clean the image exposure device when each charging device is mounted on or dismounted from the supporting member.

36. The apparatus of claim 1, wherein the photoreceptor comprises a drum base member and a photosensitive layer on the drum base member, and the thickness of the drum base member is 5 mm to 15 mm.

37. The apparatus of claim 36, wherein the drum base member has an inside diameter of from 100 mm to 200 mm.

38. The apparatus of claim 36, wherein the drum base member is made of aluminum.

39. The apparatus of claim 1, wherein the plurality of developing devices comprises four sets of the developing devices and each developing device is inserted through setting holes provided on the supporting cylinder to working positions on which each developing device develops the latent images or retracted from the working position to a rest position.

40. The apparatus of claim 39, wherein the four sets of developing devices are mounted radially on the supporting member in such a manner that two sets of the developing devices are inserted horizontally from right and left sides of the supporting member, and another two sets of the developing devices are inserted from the slightly right and left sides from the top of the supporting member.

41. The apparatus of claim 39, wherein each developing device is separably provided with a toner replenishing container.

42. The apparatus of claim 1, wherein the supporting member comprises a cylindrical member.

43. The apparatus of claim 42, wherein:

the photoreceptor has a circumferential surface; and the cylindrical member comprises:

a cylinder section spaced with a predetermined spacing from the circumferential surface of the photoreceptor; and flanges provided on both ends of the cylinder section.

* * * * *